US007198714B2

(12) United States Patent
Swistun

(10) Patent No.: US 7,198,714 B2
(45) Date of Patent: Apr. 3, 2007

(54) GUTTER SCREEN ASSEMBLY WITH WATER TENSION BREAKER

(76) Inventor: Kazimierz Swistun, 1149 Parker La., Buffalo Grove, IL (US) 60089

( * ) Notice: Subject to any disclaimer, the term of this patent is extended or adjusted under 35 U.S.C. 154(b) by 102 days.

(21) Appl. No.: 11/072,790

(22) Filed: Mar. 4, 2005

(65) Prior Publication Data

US 2005/0155919 A1 Jul. 21, 2005

Related U.S. Application Data

(63) Continuation-in-part of application No. 10/760,561, filed on Jan. 20, 2004, now Pat. No. 7,056,433.

(51) Int. Cl.
*E04D 13/076* (2006.01)

(52) U.S. Cl. ..... 210/162; 210/474; 210/489; 210/499; 52/12

(58) Field of Classification Search ..... 210/162, 210/474, 488, 489, 499; 52/12, 11
See application file for complete search history.

(56) References Cited

U.S. PATENT DOCUMENTS

| | | | | |
|---|---|---|---|---|
| 474,442 | A | 5/1892 | Byers et al. | |
| 870,165 | A | 11/1907 | Hagler et al. | |
| 3,169,111 | A * | 2/1965 | Rose et al. | 210/499 |
| 4,253,281 | A | 3/1981 | Ruttenberg | |
| 4,404,775 | A | 9/1983 | Demartini | |
| 4,644,704 | A | 2/1987 | Pedgonay | |
| 4,696,751 | A * | 9/1987 | Eifling | 210/499 |
| 4,745,710 | A | 5/1988 | Davis | |
| 4,765,101 | A | 8/1988 | Wolf | |
| 4,959,932 | A | 10/1990 | Pfeifer | |
| 5,056,276 | A | 10/1991 | Nielsen et al. | |
| 5,109,640 | A | 5/1992 | Creson | |
| 5,257,482 | A | 11/1993 | Sichel | |
| 5,321,920 | A | 6/1994 | Sichel | |
| 5,406,754 | A | 4/1995 | Cosby | |
| 5,566,513 | A | 10/1996 | Herren | |
| 6,164,020 | A | 12/2000 | Nitch | |
| 6,205,715 | B1 * | 3/2001 | Rex, Jr. | 52/12 |
| 6,427,388 | B1 | 8/2002 | Brochu | |
| 6,463,700 | B2 | 10/2002 | Davis | |
| 6,598,352 | B2 | 7/2003 | Higginbotham | |
| 6,719,148 | B2 * | 4/2004 | Perala | 210/499 |
| 2001/0009083 | A1 | 7/2001 | Sullivan | |
| 2001/0037610 | A1 | 11/2001 | Davis | |

(Continued)

*Primary Examiner*—Christopher Upton
(74) *Attorney, Agent, or Firm*—Meroni & Meroni, P.C.; Charles F. Meroni, Jr.; Christopher J. Scott

(57) ABSTRACT

The present invention provides a gutter screen attachment and a ridged filter assembly for minimizing water film runoff and debris collection adjacent a screened gutter. The screen attachment comprises a superior breaker edge, an inferior breaker edge, and a screen-receiving region. The superior breaker edge extends upwardly opposite the inferior breaker edge and is designed to break the water tension of a water film formed upon the gutter screen. The ridged filter assembly comprises a filter support grid, a filter screen and a ridge-forming member sandwiched between the filter support grid and the filter screen. The filter screen is form fit to the underlying structures and the ridge-forming member thus forms a water tension straining ridge upon the filter screen. The superior breaker edge and the filter screen ridge function to allow water to permeate through the gutter screen.

6 Claims, 12 Drawing Sheets

U.S. PATENT DOCUMENTS

2002/0100223 A1 8/2002 Brochu
2002/0166290 A1 11/2002 Bergeron
2002/0175120 A1* 11/2002 Norell et al. ..... 210/162
2003/0009951 A1 1/2003 Bergeron
2003/0046876 A1 3/2003 Higginbotham
2003/0070366 A1 4/2003 Beyers
2003/0110712 A1 6/2003 Brochu
2006/0123710 A1* 6/2006 Lenney et al. ..... 52/12

* cited by examiner

GUTTER SCREEN ASSEMBLY WITH WATER TENSION BREAKER

PRIOR HISTORY

This application is a continuation-in-part patent application claiming the benefit of U.S. patent application Ser. No. 10/760,561 now U.S. Pat. No. 7,056,433, filed in the United States Patent and Trademark Office on Jan. 20, 2004.

BACKGROUND OF THE INVENTION

1. Field of the Invention

The present invention generally relates to an improved gutter screen assembly for installation on gutters. More particularly, the present invention relates to an edging device and a filtering ridge assembly for attachment to gutter screens to improve or enhance the effectiveness of gutter screens by minimizing water runoff and debris collection adjacent the outfitted gutter.

2. Description of the Prior Art

Water molecules comprise two atoms of hydrogen and one atom of oxygen; water is thus often referred to by its chemical composition: $H_2O$. The unique chemical composition of water contributes to a certain "sticky" property of water. When molecules stick together, they do so as a result of hydrogen bonding and when water is in a liquid state, the hydrogen bonds are very fragile. The hydrogen bonds form, break, and re-form with great frequency. Each hydrogen bond lasts only a few trillionths of a second, but the molecules bond promiscuously to a succession of neighbors, giving water fairly firm structure. Collectively, the hydrogen bonds hold the substance together, a phenomenon known as cohesion.

Cohesion due to hydrogen bonding contributes to the transport of water against gravity and it is this property that has led to the development of the present invention. Related to cohesion is surface tension, which is a measure of how difficult it is to stretch or break the surface of a liquid. At the interface between water and air is an ordered arrangement of water molecules, hydrogen bonded to one another and to the water below, making the water behave as though it were covered with an invisible film. Surface tension causes water on a surface to bead into a spherical shape having the smallest ratio of area to volume, maximizing the number of hydrogen bonds that can form.

Water has a great surface tension. If one could see molecules of water and how they act, one would notice that each water molecule electrically attracts its neighbors. Readily observable, however, is the tendency for water to form droplets rather than to spread out. Further, as is perhaps most famously appreciated by the water strider insect, the surface of a body of water is held together in a film. It is noted that if the molecules of a liquid did not attract one another, then the constant thermal agitation of the molecules would cause the liquid to instantly boil or evaporate.

Hydrogen atoms have single electrons which tend to spend a lot of their time "inside" the water molecule, toward the oxygen atom, leaving their outsides naked, or positively charged. The oxygen atom has eight electrons, and often a majority of them are around on the side away from the hydrogen atoms, making this face of the atom negatively charged. Since opposite charges attract the hydrogen atoms of one water molecule like to point toward the oxygen atoms of other molecules. Of course, in the liquid state, the molecules have too much energy to become locked into a fixed pattern; nevertheless, the numerous temporary "hydrogen bonds" between molecules make water an extraordinarily sticky fluid.

Within the water, at least a few molecules are away from the surface and every molecule is engaged in a tug of war with its neighbors on every side. For every "up" pull there is a "down" pull, and for every "left" pull there is a "right" pull, and so on, so that any given molecule feels no net force at all. At the surface things are different. There is no up pull for every down pull, since of course there is no liquid above the surface; thus the surface molecules tend to be pulled back into the liquid and it requires work to pull a molecule up to the surface. If the surface is stretched—as when you blow up a bubble—it becomes larger in area, and more molecules are dragged from within the liquid to become part of this increased area. This "stretchy skin" effect is what is commonly referred to as surface tension. It will thus be seen that surface tension thus plays an important role in the way liquids behave.

When rain drops come into contact with a roof, the droplets do adhere to one another via the described atomic processes. Additionally, the droplets interact with the roof surface and with a gutter screen surface via similar atomic processes. If an observer were to inspect a gutter screen during a rain shower, the observer would no doubt see that the water-accepting apertures in the gutter screen often become filled with a film of water. On this macroscopic scale, it may be further observed that additional forces act upon the newly forming body(ies) of water. In this regard, it is observed that the gravitational forces, normal forces and frictional forces combine to create a net force causing the rainwater to flow in a direction toward gutter systems, which are primarily designed to catch, collect and divert water runoff to downspouts for directing roof water away from building structures to prevent water damage.

It is noted that the prior art gutter screen systems teach a number of gutter screen systems having varying levels of effectiveness. The gutter screen systems, as described and taught, for example, by U.S. Pat. No. 5,257,482 ('482 patent) and U.S. Pat. No. 5,321,920 ('920 patent) perform fairly well. However, it is noted that in order to catch a maximum of roof water runoff, the screen or mesh components of the '482 patent and the '920 patent have to be precisely curved or made concave to the external viewpoint during installation. In this last regard, it should be particularly noted that in order for such a curved gutter screen to properly perform, the same must be installed by well trained and experienced installers. The gutter protection systems as taught by U.S. Pat. No. 6,164,020 ('020 patent) and the '482 patent and are likely to fail (or perform poorly) if inexperienced persons install the same, such as may be the case when such systems are sold to the public as a cost effective do-it-yourself system. Given an improper installation, some of the roof water runoff runs over the edge of the gutter system, thus defeating the very purpose of the gutter system. Thus the curved screens as exemplified by the '482 patent, the '920 patent, and the '020 patent, when properly installed, effectively allow roof water runoff to permeate the water-accepting grid or screen. However, it is the curved feature of these types of screens that tends to contribute to debris collection over time. Given sufficient time and debris collection, the water-accepting grid becomes clogged with debris, thereby decreasing the effectiveness of the gutter screen, and ultimately leading to probable water damage.

Since debris collection may lead to screen clogging and eventual damage to either the home or other building, home and building owners thus typically consider the described debris collection highly troublesome. Angled, planar gutter screens are generally considered preferable to curved gutter screens in terms of providing means for allowing debris to freely translate from the roof border region, over the gutter opening to a state of free fall adjacent the affixed gutter. It will thus be noted that by installing the gutter screen in a taught, straight or substantially planar configuration, as exemplified by U.S. Pat. No. 4,644,704 ('704 patent)), one may be able to significantly reduces debris collection on the gutter screen.

However, when gutter screens or mesh installations are installed in a taught, straight, or substantially planar manner, roof water runoff has a tendency to flow over the edge of the gutter due to water surface tension and momentum. A common method or means of preventing water runoff from flowing over the edge of the gutter is to install a relatively tall edging (often referred to as "walls" or "guards") at the inferior most edge of the gutter screen (as taught by U.S. Pat. Nos. 4,765,101; 5,566,513; 6,427,388, respectively). It is noted that these so-called walls or guards effectively stop the roof water runoff. However, these walls or guard structures also have a tendency to collect debris behind them, which debris collection also leads to screen clogging, and eventual water damage, substantially as earlier described.

Moreover, it has been recently noted that building structures located in regions having a high population of ash trees and/or various types of evergreens tend to collect a great deal of debris atop screened gutters. In this regard, it has been noted that the seeds of ash trees and the needles of evergreens, when dispersed from the parenting trees, often become lodged in screen systems otherwise cooperatively associated with gutter systems. Once lodged, other debris may thus become more easily lodged behind the first accumulated debris leading to further clogging of the gutter outfitted with an anti-debris screen or the like. In this regard, it has been noted that fine mesh filter screens and solid gutter covers provide excellent means to guard against debris collection, small seeds and needles, the needles, small seeds or other small-dimensioned matter being too large in magnitude to become lodged in a fine mesh filter screen (the fine mesh filter screens typically having apertures on the order of 40–200 microns). With regard to solid covers, needles, small seeds, and other small-dimensioned matter are typically washed off solid gutter covers via the water runoff. However, even debris having relatively large dimension may also gain entry to solid gutter guard shields. In this regard, it is noted that the greater the force inherent with water runoff, the greater the tendency for large dimensioned debris to enter the gutter. However, when a certain water runoff volume is reached, the water runoff begins to run over the system, thus defeating the purpose of the solid gutter shield system. Thus, it is further noted that fine mesh filter screens and solid gutter covers tend to favor water runoff, particularly in high water volume scenarios. Further, a common problem associated with clogging is seam design. The presence of seams at the edges of adjacent screen portions often cause debris of various sizes to collect and accumulate, thus leading to a clog of the gutter screen at the seam site.

Notably, U.S. Pat. No. 5,406,754 ('754 patent), which issued to Cosby, discloses a Drain Gutter Debris Guard and Method of Making. The '754 patent teaches an improved gutter guard comprising a fine screen supported by a structural stiffening matrix support. The fine screen prevents the penetration of fine, small-dimensioned debris while the stiffening matrix support strengthens the fine screen against bending in order to bridge the opening of a conventional gutter. Further, U.S. Pat. No. 6,463,700 ('700 patent), which issued to Davis, discloses a Composite Gutter Guard. The '700 patent teaches a composite gutter guard adapted for positioned placement at an opening of a longitudinally extending, generally U-shaped gutter used for collecting and distributing rainwater runoff from the roofs of residential homes and other buildings. The gutter guard includes an elongate polymer guard panel defining a plurality of spaced filter openings. The guard panel is adapted to extend laterally across the opening of the gutter and longitudinally along the length of the gutter. A polymer coated mesh layer overlies the guard panel to capture and separate debris from rainwater runoff entering the gutter. A heat weld connects the mesh layer to the guard panel. Neither the '754 patent nor the '700 patent, however, teach means cooperatively associated with the superior surface of the fine mesh screen for straining or breaking the water surface tension of a water film formed upon the surface so as to direct or siphon more voluminous amounts of water into the underlying gutter. Without such means, high water volume runoff continues to plague the devices taught by the '754 and '700 patents. Further, it is noted that the '700 patent teaches a gutter system comprising a plurality of relatively short rigid (non-rollable) sections joined at a plurality of seams along the general gutter span. Notably, the higher the number of seams, the higher the tendency for debris to be caught and collected, thus leading to clogging of the gutter system. Notably, so-called reverse curve gutter protection systems also are deficient at guarding against high water volume scenarios. The present invention discloses certain water surface tension-breaking means or water tension-straining means cooperatively associated with the planar structural portions of reverse curve gutter configurations so as to break or strain water surface tension at the planar portions and further make use of the water surface tension at the reverse curve portions (of the overall reverse curve design) to allow water film to follow the reverse curve into the gutter situated underneath the reverse curve gutter shield.

The present disclosures address the foregoing problems associated with fine debris (ash tree seeds, evergreen needles, and the like), high water volume runoff, and reverse curve gutter protection system problems. It will thus be seen from a review of the above-referenced patents and other prior art generally known to exist, it will be seen that the prior art does not teach a structure, uniquely configured for breaking the water surface tension of water films formed upon gutter screen applications. Further, the prior art does not teach a structure is usable in connection with existing angled, planar gutter screen systems for improving or enhancing the effectiveness thereof by functioning to both break water surface tension of water films and allow bulky debris to translate over the water tension breaker. The prior art thus perceives a need for a water tension breaker or water surface tension strainer usable in combination with a gutter screen to provide a means to break or otherwise interrupt the surface tension of water and allow water-accepting grids or regions to accept greater quantities of water runoff, thereby reducing "over-the-edge" water runoff, and further to prevent or minimize debris collection upon the gutter screen.

SUMMARY OF THE INVENTION

Accordingly, it is an object of the present invention to provide a low cost, maintenance-efficient gutter screen assembly, which gutter screen assembly enables the user to simultaneously (1) break the water surface tension of roof water runoff upon gutter screens, mesh, grids, and the like, thus allowing water-accepting screens, mesh, grids or regions installed on gutters to accept greater quantities of roof water runoff, thereby reducing "over-the-edge" roof water runoff, (2) prevent or minimize debris collection upon the gutter screen, and (3) significantly reduce the overall gutter protection system cost by eliminating (a) the need for highly trained experienced installers and (b) the need for a specific customer service system guaranteeing expected results.

It is a further object of the present invention to provide a gutter screen termination trim for use in combination with a gutter screen, which gutter screen termination trim embodies improvements over the state of the art. Further, it is an object of the present invention to provide a gutter screen assembly constructed from low cost materials, formed into a readily reversible gutter screen attachment for installation on either heavy roof water runoff or typical roof water runoff applications.

To achieve these and other readily apparent objectives, the present invention provides a uniquely configured gutter screen attachment or gutter screen termination trim comprising a water tension breaker for use in combination with a conventional gutter and angled, planar gutter screen. The resulting gutter screen assembly is designed for minimizing roof water runoff and debris collection adjacent a conventional gutter. Such gutters essentially comprise a roof-engaging portion and a substantially horizontal gutter rim portion opposite the roof-engaging portion. The gutter rim portion essentially comprises an inner rim edge and an outer rim edge. The roof-engaging portion is typically affixed adjacent a roof border region of a building structure or home.

The gutter screen assembly essentially comprises, in combination, a gutter screen and a gutter screen termination trim comprising a water tension breaker. The gutter screen itself essentially comprises a plurality of edges, including a roof-engaging edge, a gutter-engaging edge, and two latitudinally-opposed screen edges. One embodiment of the gutter screen comprises a plurality of longitudinally-aligned ribs extending from the roof-engaging edge to the gutter-engaging edge, and a plurality of latitudinally-aligned ribs extending intermediate the latitudinally-opposed screen edges. The longitudinally-aligned ribs intersect with the latitudinally-aligned ribs and thus form a series of intersection points. The longitudinally-aligned ribs, the latitudinally-aligned ribs and the intersection points together define a substantially planar water-accepting grid.

The gutter screen termination trim with water tension breaker essentially comprises a substantially vertical superior breaker edge, a substantially vertical inferior breaker edge, and a substantially horizontal screen-receiving region intermediate the superior and inferior breaker edges. The superior and inferior breaker edges are substantially coplanar. The screen-receiving region essentially comprises an edge-receiving fold, which edge-receiving fold in turn essentially comprises a substantially U-shaped edge and two substantially parallel edge-engaging regions. The edge-receiving fold is designed to receive the gutter-engaging edge of the gutter screen, thus sandwiching the gutter-engaging edge intermediate the edge-engaging regions. The roof-engaging edge of the screen is affixed adjacent the roof border region of the subject building structure. The edge-receiving fold and gutter-engaging edge are affixed in superior adjacency to the gutter rim portion such that the inferior breaker edge extends downwardly snugly adjacent the inner rim edge and thus functions to position the gutter screen termination trim atop the gutter rim portion. The U-shaped edge is designed to be spatially located in superior adjacency to, or substantially flush with, the outer rim edge. The superior breaker edge thus extends upwardly opposite the inferior breaker edge and is designed to break the water tension of a water film formed upon the gutter screen. Further, the superior breaker edge is of minimized vertically-extending height so as to allow bulky debris to translate over the superior breaker edge and off the U-shaped edge of the gutter screen termination trim for free fall to the ground below. It is thus contemplated that the superior breaker edge functions to allow water to more properly permeate through the water-accepting grid into the gutter.

Usable in combination with the summarized gutter screen termination trim is a further aspect or embodiment of the present invention. The present invention further provides a gutter screen assembly for minimizing water runoff and debris collection adjacent a gutter, which assembly comprises a filter support grid, a form-fitting filter screen, and at least one ridge-forming member. The filter support grid essentially comprises a roof-engaging grid edge, a rim-opposing grid edge, two latitudinally-opposed grid edges, a filter-supporting, water inlet grid surface, and a water outlet grid surface. The grid surfaces extend intermediate the grid edges. The filter screen essentially comprises a roof-engaging filter edge, a rim-opposing filter edge, two latitudinally-opposed filter edges, a water inlet filter surface, and a water outlet filter surface. The filter surfaces extend intermediate the filter edges.

The ridge-forming member extends intermediate the water inlet grid surface, the water outlet filter surface, and the latitudinally-opposed grid edges and filter edges. The filter screen is then form fit to the grid surface and the ridge-forming member, whereby the ridge-forming member thus forms an energy-absorbing filter ridge at the water inlet filter surface. The energy-absorbing filter ridge functions to strain the water surface tension of a water film formed upon the filter screen, thereby allowing water to more easily permeate or siphon through the filter screen and the filter support grid into the gutter.

The dual-layered gutter screen assembly is thus further usable in connection with reverse curve gutter guards and the like. In this regard, the present invention further contemplates a dual-layered gutter screen assembly for minimizing water runoff and debris collection adjacent a gutter, which assembly essentially comprises a superior water filter layer or filter screen and an inferior filter support layer or filter support grid. The water filter layer comprises a substantially planar filter portion, a reverse curve filter portion, a water inlet filter surface, and a water outlet filter surface. Similarly, the filter support layer comprises a substantially planar support portion, a reverse curve support portion, a water inlet support surface, and a water outlet support surface. The water filter layer and the filter support layer function to allow water to permeate from water inlet filter surface to the water outlet filter surface to the water inlet support surface to the water outlet support surface and to the gutter or gutter assembly situated thereunder. A large portion or volume of water runoff is thus able to permeate through the assemblage into the gutter and the remainder of the water runoff, if any, will follow the reverse curve into the gutter via a space immediately superior to the gutter rim portion.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of my patent drawings, as follows:

FIG. 1(*a*) is an enlarged fragmentary view of the preferred gutter screen assembly as depicted in FIG. 1.

FIG. 2(*a*) is an enlarged fragmentary view of the preferred gutter screen assembly as depicted in FIG. 2.

FIG. 11(*a*) is an enlarged fragmentary view of the sixth alternative embodiment of the gutter screen assembly as depicted in FIG. 11.

FIG. 13(*a*) is a cross-sectional view of the filter support grid of the sixth alternative embodiment of the gutter screen assembly as taken from FIG. 13.

DETAILED DESCRIPTION OF THE PREFERRED EMBODIMENT(S)

After careful observation and experiment, it was discovered that what seems like typical "over-the-edge" roof water runoff, is often a very thin film of water. This thin film of water has a tendency to run over the water-accepting apertures of a variety of gutter screens due to its water tension. In other words the hydrogen bonds in thin films of water are sufficiently strong to overcome gravitational forces and thus function to cause water film overflow in many gutter screen systems, especially when the screen is installed in a planar configuration without being curved down. The solution was to develop a small raised edge along the path of the described thin water film water runoff or overflow. The raised edge must be tall enough to break the water tension, but short enough so it does not create a wall, behind which small debris may collect. The small raised edge may thus be referred to as a water tension breaker. By installing a properly configured gutter screen termination trim with water tension breaker on a gutter screen, water film formed upon the gutter screen may more readily be broken, thus allowing water to more readily permeate through the water-accepting grid or screen. Furthermore, given the minimized height of the water tension breaker, the water tension breaker also functions to minimize debris collection.

Figure 1:
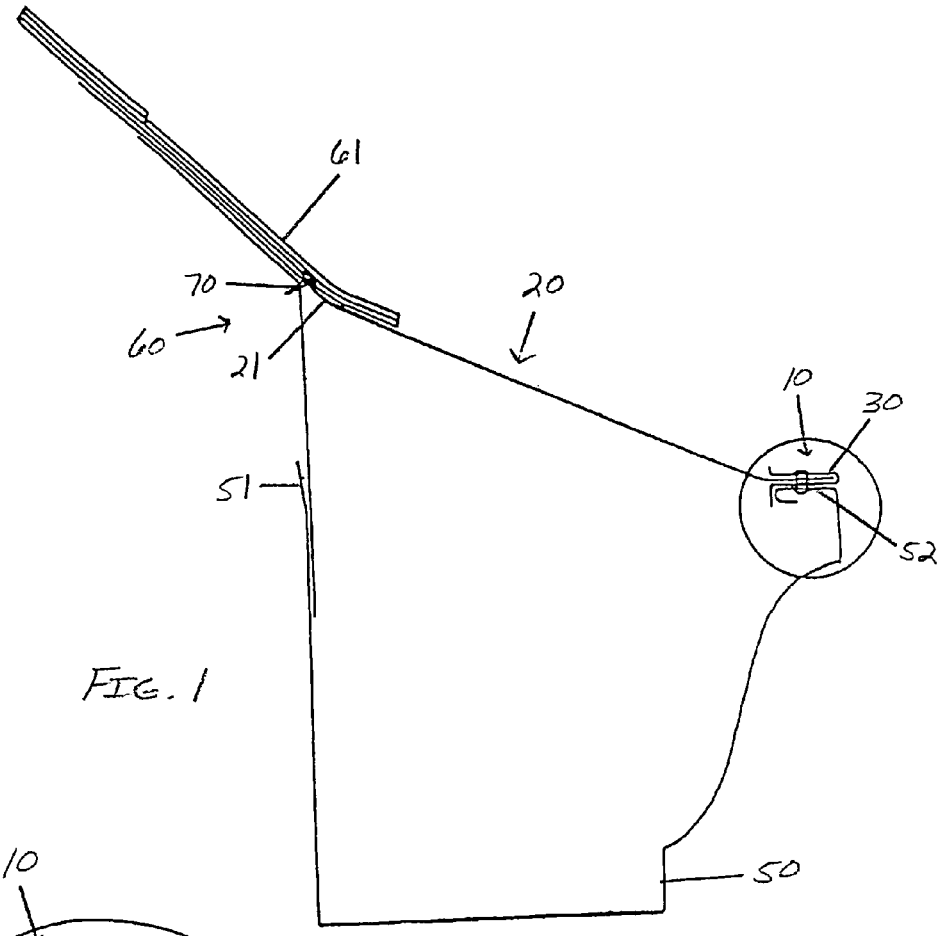
FIG. 1 is a fragmentary cross-sectional side view of a roof border region, a gutter, and the preferred gutter screen assembly.
Figure 1A:
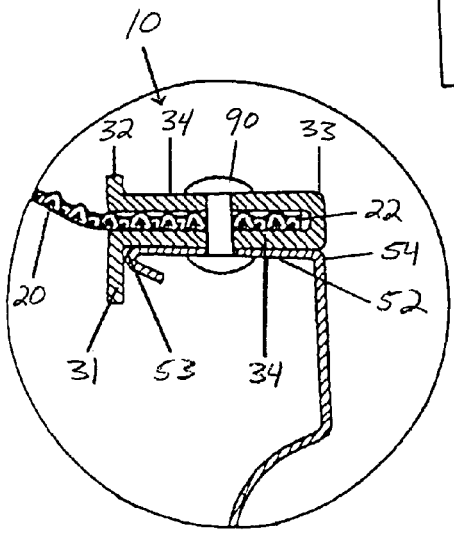

Referring now to the drawings, the preferred embodiment of the present invention is contemplated for use in roofing scenarios where roofing materials comprise asphalt shingles that allow insertion of gutter screens thereunder at the roof edge or termination. The preferred embodiment of the present invention thus concerns a gutter screen assembly 10 for use in combination with a conventional gutter 50 to minimize roof water runoff and debris collection. Gutter screen assembly 10 is generally referenced in FIGS. 1–3; gutter 50 is generally illustrated in FIGS. 1, 1(*a*), 3, and 4; and a typical roof border region 60 is illustrated in FIGS. 1, 2, and 3–9. The preferred embodiment of gutter screen assembly 10 for minimizing water runoff and debris collection is designed for use in combination with gutter 50. In this regard, it is contemplated that gutter 50 preferably comprises a roof-engaging portion 51 as illustrated in FIGS. 1, 3, and 4; and a substantially horizontal gutter rim portion 52 as illustrated in FIGS. 1, 1(*a*), and 3. Gutter rim portion 52 preferably comprises an inner rim edge 53 and an outer rim edge 54 as generally illustrated in FIGS. 1 and 3, and as specifically referenced in FIG. 1(*a*). It will thus be seen that roof-engaging portion 51 is designed for fixed placement adjacent roof border region 60. As has been illustrated in FIGS. 1 and 3, roof-engaging portion 51 is preferably affixed adjacent roof border region 60.

Figure 2:
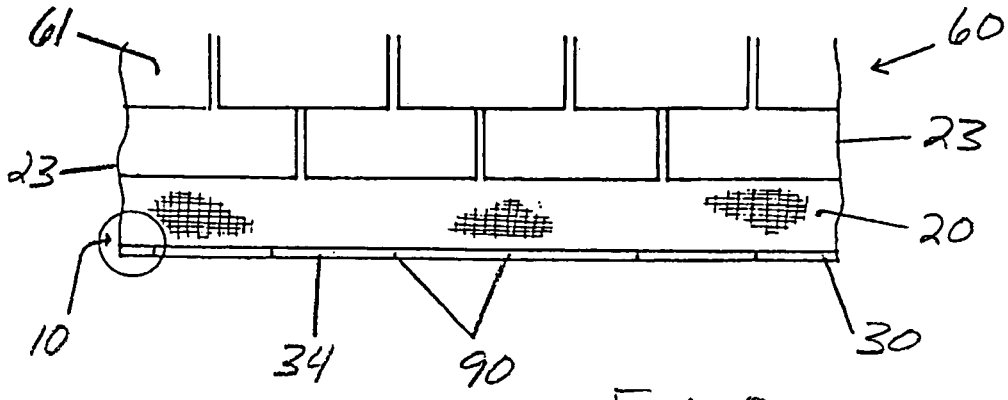
FIG. 2 is a fragmentary top plan view of a roof border region and the preferred gutter screen assembly.
Figure 2A:
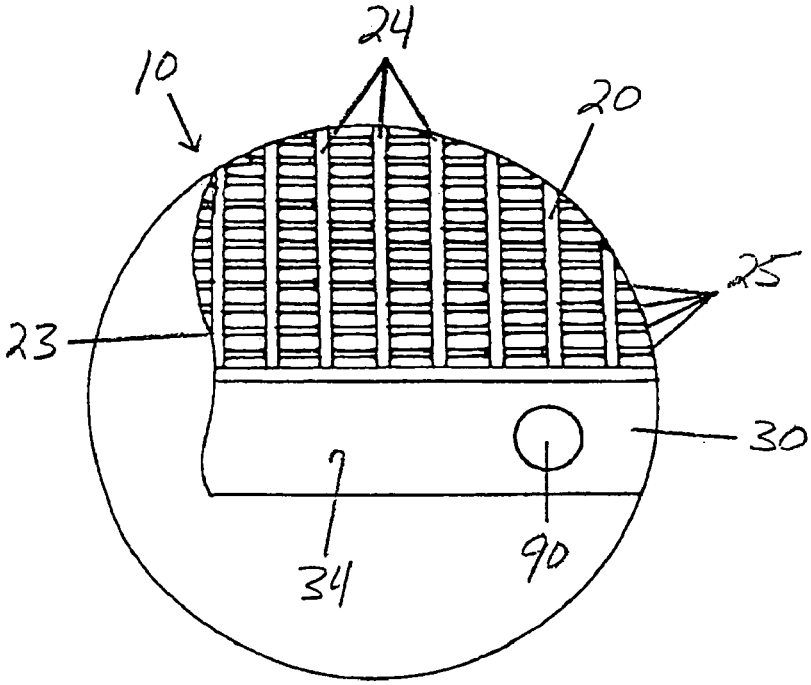
Figure 3:
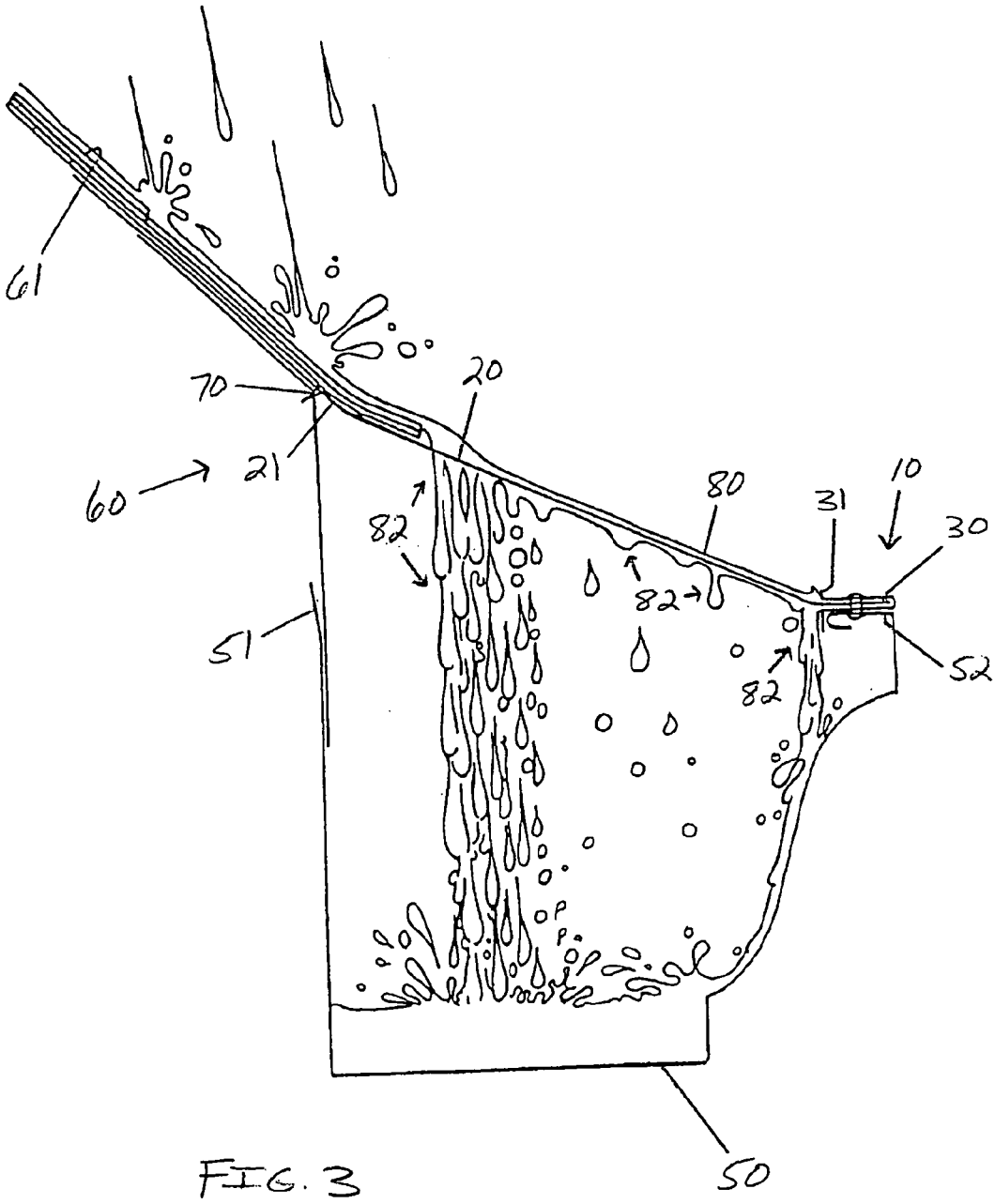
FIG. 3 is a fragmentary cross-sectional side view of a roof border region, a gutter, and the preferred gutter screen assembly, depicting roof water runoff and gutter collection thereof.
Figure 4:
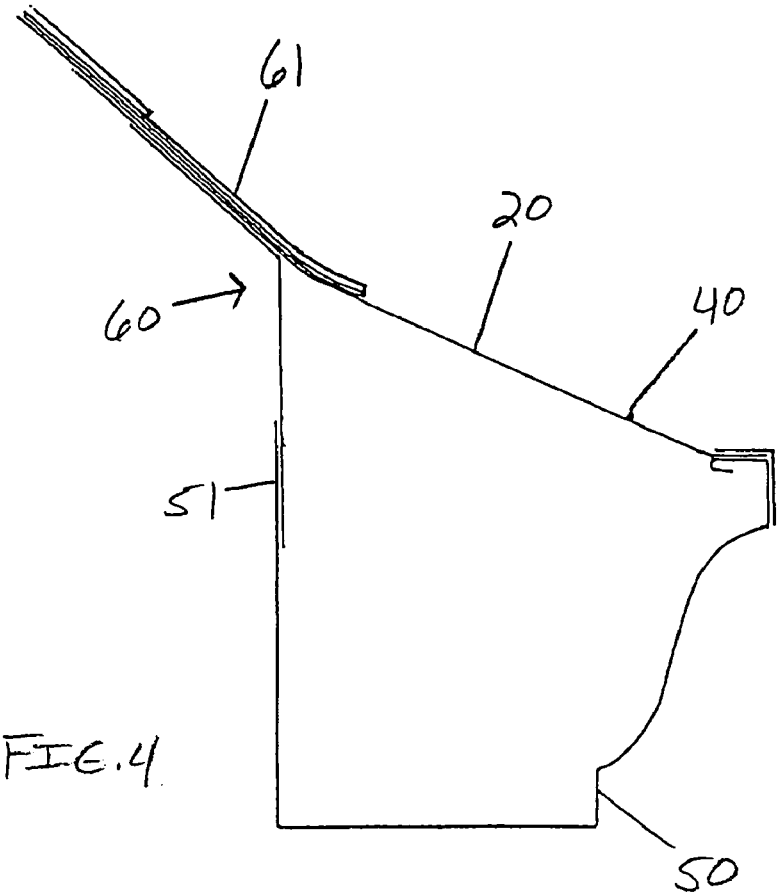
FIG. 4 is a fragmentary cross-sectional side view of a roof border region, a gutter, and a first alternative embodiment of the gutter screen assembly.

Gutter screen assembly 10 preferably comprises, in combination a gutter screen 20 as illustrated in FIGS. 1–9; and a gutter screen termination trim 30 as also illustrated in FIGS. 1–3. Gutter screen 20 is preferably constructed from Ultraviolet (UV) protective plastic (preferably black), the durability of which can be warranted for at least 10 years. Excellent results have been obtained when gutter screen 20 is constructed from a LEAFSCREENER brand screen, mesh, or water-accepting grid as manufactured and sold by The Leafscreener System USA, Inc., 1305 F. Street, Floresville, Tex., 78114.

Preferably, gutter screen 20 comprises a plurality of border edges and a substantially planar water-accepting region or water-accepting grid intermediate the border edges. The border edges preferably include a roof-engaging edge 21 as illustrated in FIGS. 1 and 3; a gutter-engaging edge 22 as illustrated in FIG. 1(*a*); and two latitudinally-opposed screen edges 23 as referenced and represented at the boundary regions of the fragmentary views of FIGS. 2 and 2(*a*). It will be further seen that gutter screen 20 preferably comprises a plurality of longitudinally-aligned ribs 24, which ribs 24 extend from roof-engaging edge 21 to gutter-engaging edge 22 as generally illustrated in FIG. 2(*a*). Still further, it will be seen that gutter screen 20 preferably comprises a plurality of latitudinally-aligned ribs 25, which ribs 25 extend intermediate latitudinally-opposed screen edges 23 as generally illustrated in FIG. 2(*a*). It will thus be understood from an inspection of FIG. 2(*a*) that longitudinally-aligned ribs 24 preferably intersect with latitudinally-aligned ribs 25 thus forming a series of intersection points. Together, longitudinally-aligned ribs 24, latitudinally-aligned ribs 25 and the intersection points define a substantially planar water-accepting grid as is generally depicted in FIGS. 2 and 2(*a*). From an inspection of FIGS. 1 and 3, the reader will appreciate that gutter screen 20 is a water-accepting grid or water-accepting region that is substantially planar in orientation. It will be recalled that planar screen configurations are preferable to curved screen orientations when minimization of debris collection is desired.

It should be noted that longitudinally-aligned ribs 24 preferably have a substantially uniform latitudinal distance therebetween and that latitudinally-aligned ribs 25 have a substantially uniform longitudinal distance therebetween. In this regard, the preferred latitudinal distance ranges from a dimension greater than zero (0) to about 5 millimeters (mm) and the preferred longitudinal distance ranges from a dimension greater than zero (0) to about 1.75 mm. The resulting water-receiving apertures thus function to keep debris with structural dimensions larger than those here specified from entering the gutter. It will be recalled that LEAFSCREENER brand water-accepting grids or screens have proven to be highly effective for keeping debris from entering gutter systems. However, the water-receiving apertures so defined by longitudinally-aligned ribs 24 and latitudinally-aligned ribs 25 are so dimensioned so as to also enable gravity-defying water films to form.

It should be noted that the present invention may be used in combination with a host of variably constructed water-accepting grids or screens comprising water-accepting apertures of various shapes and sizes. The above description is intended as a preferred specification of the ideal water-accepting grid and is not meant to any way limit the present invention. For example, it is contemplated that the present invention may be used in combination with water-accepting grid or screen having diagonally aligned ribs, thus forming parallelogram-shaped or diamond-shaped water accepting apertures. Screens of this type may also be successfully used in combination with the present invention. Excellent results have been obtained, however, utilizing a water-accepting grid substantially as earlier described.

To remedy water film runoff, gutter screen assembly 10 further comprises gutter screen termination trim 30 as earlier indicated. Gutter screen termination trim 30 is also preferably constructed from Ultraviolet (UV) protective plastic (preferably black), the durability of which can be warranted for at least 10 years. It should be noted that other materials such as 0.024 gauge aluminum (with a black finish) may be used in the construction of gutter screen termination trim 30. In this regard, it is noted that aluminum is more durable than plastic, and thus it will last longer than plastic. However, the final product will be more expensive when aluminum is used as opposed to when the described plastic is used. Further, the screen or mesh as provided by manufacturers such as The Leafscreener System USA, Inc. typically warrant the durability of the product for about 10 years. It is thus contemplated that a material providing durability to match that of the gutter screen 20 is to be preferred, so as to keep costs of installation and maintenance at a minimum.

Gutter screen termination trim 30 preferably comprises a substantially vertical first breaker edge, a substantially vertical second breaker edge, a select positioning breaker edge 31 as illustrated in FIG. 1(*a*), a select tension-breaking breaker edge 32 as illustrated in FIG. 1(*a*), and a substantially horizontal screen-receiving region intermediate the first and second breaker edges. The select breaker edges, namely, select positioning breaker edge 31 and select tension-breaking breaker edge 32, are preferably defined by being selected from the group consisting of the first and second breaker edges. In other words, it is contemplated that the termination trim or gutter screen termination trim 30 is preferably reversible, depending on the specific gutter/roof setup. The taller edge works much better at the areas with high water volume, such as roof valley exits to inside gutter corners. Gutter screen termination trim 30 is preferably made in 5 foot lengths for easy shipment, while gutter screen 20 may be shipped in continuous lengths or rolls per a given application.

The first and second breaker edges (i.e. select positioning breaker edge 31 and select tension-breaking breaker edge 32) are preferably substantially coplanar as may be seen from a general inspection of FIG. 1(*a*). The screen-receiving region preferably comprises a (screen) edge-receiving fold, which preferably comprises a substantially U-shaped edge 33 and two substantially parallel edge-engaging regions 34 as illustrated in FIGS. 1(*a*), 2 and 2(*a*). The edge-receiving fold is thus designed to receive gutter-engaging edge 22 such that the edge-receiving fold effectively sandwiches gutter-engaging edge 22 intermediate edge-engaging regions 34. Gutter screen termination trim 30 is preferably fastened to gutter rim portion 52 with fasteners 90 as illustrated in FIG. 1(*a*). Fasteners 90 may comprise rivets or screws.

Roof-engaging edge 21 is designed for fixed attachment adjacent roof border region 60. FIGS. 1 and 3 generally depict the typical structural arrangement in which roof-engaging edge 21 is affixed adjacent roof border region 60. In this regard, it should be noted that roof-engaging edge 21 is typically attached or affixed to roof border region 60 with a fastener 70 such that roof-engaging edge 21 lies in inferior adjacency to the termination shingles 61 of roof border region 60 as generally illustrated in FIGS. 1, 3, 11, 12, and 16–19. Termination shingles 61 are further illustrated in FIGS. 2, 4–9, 11, 12 and 16–19. Oftentimes, it is not recommended that roof-engaging edge 21 be placed under the roofing materials in the described fashion, such as when slate tiles are used for roofing material. It is for this reason that roof-engaging edge 21 has been described as being designed for fixed attachment adjacent roof border region 60.

The edge-receiving fold and gutter-engaging edge 22 are thus designed for fixed attachment in superior adjacency to gutter rim portion 52 as generally depicted in FIGS. 1, 1(*a*), and 3 and as may generally be gleaned from an inspection of FIGS. 2 and 2(*a*). Gutter screen termination trim 30 may be attached to gutter rim portion 52 with screws or rivets 90 as illustrated in FIGS. 1(*a*), 2, and 2(*a*). The edge-receiving fold and gutter-engaging region 22 are thus affixed in superior adjacency to gutter rim portion 52 such that select positioning breaker edge 31 extends downwardly snugly adjacent inner rim edge 53 as most clearly illustrated in FIG. 1(*a*). It will be seen that select positioning breaker edge 31 thus serves a positioning function by enabling the installer of gutter screen termination trim 30 to more properly position gutter screen termination trim 30 upon installation. Additionally, it should be noted that the substantially vertical inferior breaker edge has an additional role of protecting against water leakage between the gutter and trim. Preferably, edge-engaging regions 34 are of sufficient dimension such that U-shaped edge 33 is spatially located in superior adjacency to, or substantially flush with, outer rim edge 54 after installation as may be generally seen from an inspection of FIG. 1(*a*).

It will be further seen that select tension-breaking breaker edge 32 preferably extends upwardly opposite select positioning breaker edge 31. It will be recalled that select tension breaking breaker edge 32 and select positioning breaker edge 31 are preferably coplanar. Select tension-breaking breaker edge 31 thus lies in a breaker plane with select positioning breaker edge 32, which breaker plane is preferably substantially parallel with the eaves of roof border region 60. In other words, it is preferred that the breaker plane is substantially vertical as are earlier specified. Select tension-breaking breaker edge 31 is thus designed for breaking the water surface tension of a water film 80 formed upon gutter screen 20 thus allowing water 81 to permeate (as depicted at 82) through the water-accepting grid into gutter 50 all as generally illustrated and referenced in FIG. 3.

The first breaker edge and the second breaker edge each have a preferred, critical measurable vertical dimension. After researching and developing the present invention, it has come to light that the preferred measurable vertical dimensions (of the first breaker edge and the second breaker edge) each may be selected from an edge dimension range, the edge dimension range ranging from about 2 mm to about 6 mm. The positioning and water breaking functions of the select positioning breaker edge and the select tension-breaking breaker edge, respectively, are realized when either of the breaker edges are dimensioned between about 2 mm and about 6 mm. However, the ideal vertical dimensions may be assigned to the breaker edges 31 and 32 when the measurable vertical dimensions are selected from a select dimension grouping, the select dimension grouping consisting of the dimensions 3 mm and 6 mm. In other words, the preferred dimensions of select positioning breaker edge 31 and select tension-breaking breaker edge 32 are selected from either 3 mm or 6 mm. It will be recalled in this regard that gutter screen termination trim 30 is reversible or upendable.

In other words, the first breaker edge may be either the superior tension-breaking breaker edge or the inferior positioning breaker edge per the installer election. In corresponding fashion, the second breaker edge may be either the superior tension-breaking breaker edge or the inferior positioning breaker edge per the installer election. While the upper edge takes the role of water tension breaker, the bottom edge prevents water leakage between gutter screen termination trim 30 and gutter rim portion 52 as earlier noted. That is, the first breaker edge may comprise either select positioning breaker edge 31 or select tension-breaking breaker edge 32 and the second breaker edge may correspondingly comprise either select tension-breaking breaker edge 32 or either select positioning breaker edge 31. In the typical application scenario, the first breaker edge is defined by select tension-breaking breaker edge 32, which edge ideally measures about 3 mm from the horizontal superior edge-engaging region 34 and the second breaker edge is defined by select positioning breaker edge 31, which edge measures about 6 mm from the horizontal inferior edge-engaging 34. In sum, the ideal height of select tension-breaking breaker edge 32 is 3 mm. After considerable amount of experiment and research, it has been discovered that given a gutter screen application, the water surface tension of a water film formed upon the gutter screen may be most successfully overcome when the water film flows against tension-breaking breaker edge having a vertical height dimension of about 3 mm. Favorable results, however, have been obtained when the select tension-breaking breaker edge comprises a vertical chosen from a range of about 2 mm to about 6 mm. A select tension-breaking breaker edge higher than 6 mm will have a tendency to start collecting debris behind it and a select tension-breaking breaker edge lower than 2 mm is insufficiently tall to break the water surface tension of a water film formed upon the gutter screen or water-accepting grid or region.

The ideal solution to significantly improve the performance of screen systems such as those taught by the '482 patent and the '920 patent is a specifically designed screen termination trim or gutter screen termination trim 30 such as been described, which gutter screen termination trim comprises two raised edges, with the ideal 3 mm raised edge on one side and the maximum 6 mm raised edge on the other side. That termination trim is reversible and in most application scenarios, installation of gutter screen termination trim 30 is such that the 3 mm edge goes up. In high water volume areas, however, the other 6 mm edge performs better. The typical example of high water volume area is an inside gutter corner, where water collected from large roof areas drains into a fairly narrow inside gutter corner. The screen/mesh may thus be inserted into the termination trim or gutter screen termination trim 30 substantially as described hereinabove and installed such that select tension-breaking breaker edge 32 measures about 6 mm in height and is in a superior water tension-breaking position.

An alternative embodiment of the present invention also concerns a gutter screen assembly for minimizing water runoff and debris collection adjacent gutter 50. The alternative embodiment of the gutter screen assembly, however, is designed such that water tension breaking edge is positioned on the screen itself instead of being integrally formed with gutter screen termination trim 30. The alternative embodiment of the present invention thus comprises, in combination gutter screen 20 (substantially as earlier described) and at least one, but possibly many, latitudinally-aligned water tension breaker(s) or raised tension-breaking member(s) 40 as comparatively illustrated in FIGS. 4–9. In this regard, it will be seen from a comparison of FIG. 4 with FIGS. 5–9 that FIG. 4 illustrates a single raised tension-breaking member and FIGS. 5–9 each illustrate a plurality of raised tension-breaking members 40 in various configurations.

Figure 5:
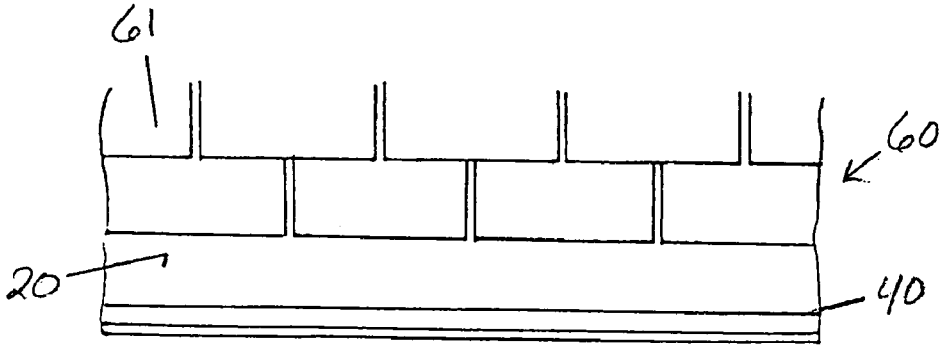
FIG. 5 is a fragmentary top plan view of a roof border region and a first alternative embodiment of the gutter screen assembly.
Figure 6:
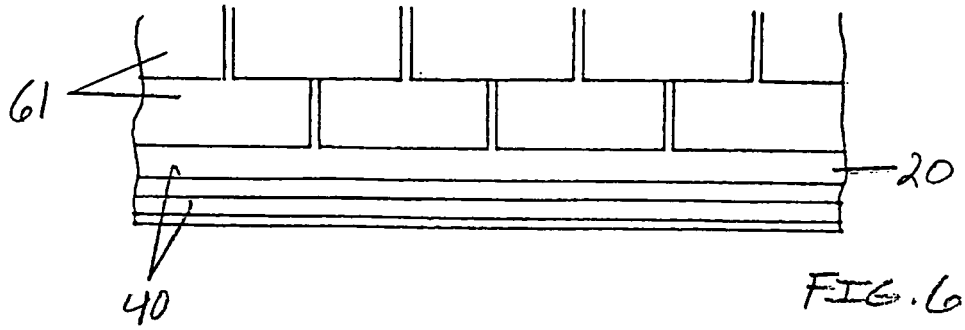
FIG. 6 is a fragmentary top plan view of a roof border region and a second alternative embodiment of the gutter screen assembly.
Figure 7:
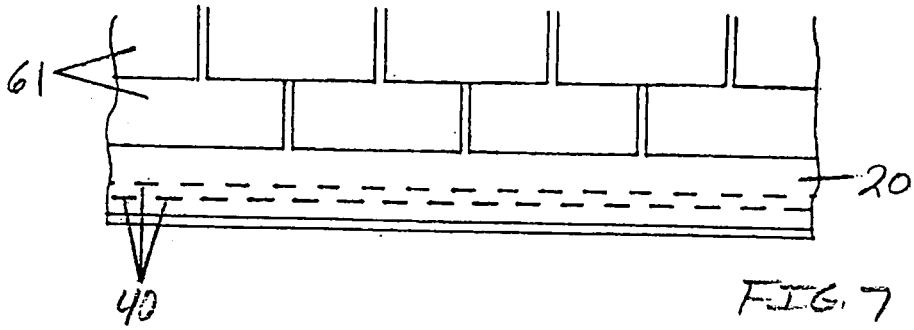
FIG. 7 is a fragmentary top plan view of a roof border region and a third alternative embodiment of the gutter screen assembly.
Figure 8:
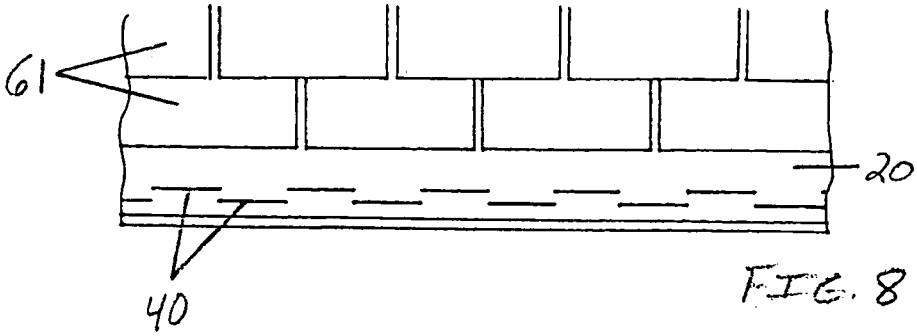
FIG. 8 is a fragmentary top plan view of a roof border region and a fourth alternative embodiment of the gutter screen assembly.
Figure 9:
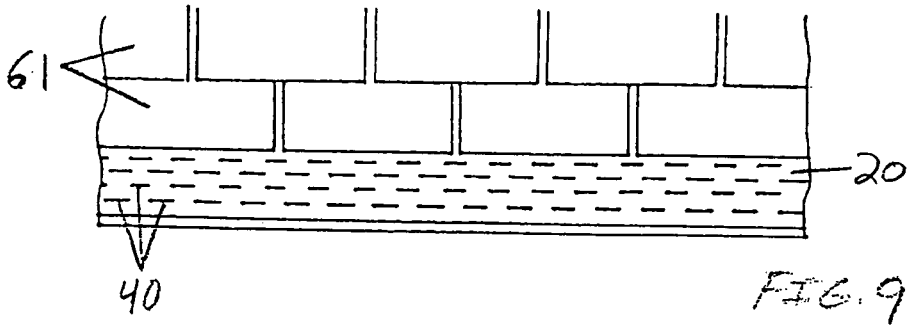
FIG. 9 is a fragmentary top plan view of a roof border region and a fifth alternative embodiment of the gutter screen assembly.

Each raised tension-breaking member 40 is preferably oriented intermediate the latitudinally-opposed screen edges and is cooperatively associated with the water-accepting grid or water-accepting region for breaking the water surface tension of a water film formed upon gutter screen 20 thus allowing water to permeate through the water-accepting grid into gutter 50. It will thus be seen that an alternative solution to water film runoff is to cooperatively associate the water tension-breaking edge with gutter screen 20 itself. The raised edge can be continuous across the length intermediate the latitudinally-opposed screen edges as generally depicted in the fragmentary views of FIGS. 5 and 6, or staggered across the length intermediate the latitudinally-opposed screen edges as generally depicted in the fragmentary views of FIGS. 7–9. In any event, each raised tension-breaking member 40 can be integrally formed as a part of gutter screen 20 (in which case gutter screen 20 would be altered to comprise raised latitudinal rib portions) or can be formed as a narrow trim for attachment to gutter screen 20. Further, as illustrated in FIGS. 4 and 5, a single raised tension-breaking member 40 may be set in the pathway of the running water, or, as illustrated in FIG. 6, a plurality of rows (two as shown) of raised tension-breaking members 40 may be set in the path of running water.

It is further contemplated that in the alternative embodiments, at least one raised tension-breaking member 40 may lie in a breaker plane, the breaker plane being either substantially orthogonal to the water-accepting grid or region or substantially vertical. In either case, it is contemplated that at least one raised tension-breaking member 40 has a measurable vertical dimension, the measurable vertical dimension being selected from a breaker dimension range, the breaker dimension range ranging from about 2 mm to about 6 mm, but preferably about 3 mm, substantially as earlier described.

It is noted that the angle of inclination of planar gutter screens is not uniform from building to building. However, it is further noted that the angle of inclination rarely exceeds 25 rotational degrees from the horizontal. If the breaker plane is orthogonal to the plane of the water-accepting grid, it is contemplated that the raised height of the tension-breaking members 40 from the plane of the water-accepting grid may be described as follows:

For an angle of inclination of about 5 degrees from the horizontal, it is contemplated that the preferable raised height of the tension-breaking member be about 3.01 mm. For an angle of inclination of about 10 degrees from the horizontal, it is contemplated that the preferably raised height of the tension-breaking member be about 3.05 mm. For an angle of inclination of about 15 degrees from the horizontal, it is contemplated that the preferably raised height of the tension-breaking member be about 3.11 mm. For an angle of inclination of about 20 degrees from the horizontal, it is contemplated that the preferable raised height of the tension-breaking member be about 3.19 mm. For an angle of inclination of about 25 degrees from the horizontal, it is contemplated that the preferable raised height of the tension-breaking member 40 be about 3.31 mm. It will thus be seen that the preferred raised perpendicular height of the tension-breaking member from the water-accepting grid may be calculated according to the formula:

$$h=[(3\text{ mm})/\text{cosine}(\theta)]$$

Where:

(1) the tension-breaking member height=(h);
(breaker plane orthogonal to water-accepting grid)
(2) the ideal vertical height=(3 mm); and
(3) the angle of inclination off horizontal for the water-accepting grid=(θ).

As has been noted, gutter screen 20 is preferably constructed from Ultraviolet (UV) protective plastic (preferably black), the durability of which can be warranted for at least 10 years. Excellent results have been obtained when gutter screen 20 is constructed from a LEAFSCREENER brand screen, mesh, or water-accepting grid, as earlier specified. Thus, it will be recalled that LEAFSCREENER brand water-accepting grids or screens have proven to be highly effective for keeping debris from entering gutter systems. It has also been noted that the present invention may be used in combination with a host of variably constructed water-accepting grids or screens comprising water-accepting apertures of various shapes and sizes. It is contemplated that the present invention may be used in combination with water-accepting grid or screen having diagonally aligned ribs, thus forming parallelogram-shaped or diamond-shaped water accepting apertures. Screens of this type may also be successfully used in combination with the present invention. Excellent results have been obtained, however, utilizing a water-accepting grid substantially as earlier described and thus has contributed to the preferred embodiment of the present invention.

As earlier described in the Background of the Invention section of this Specification, it has been recently noted that building structures located in regions having a high population of ash trees and/or various types of evergreens tend to collect a great deal of debris atop screened gutters. In this regard, it has been noted that the seeds of ash trees and the needles of evergreens, when dispersed from the parenting trees, often become lodged in screen systems otherwise cooperatively associated with gutter systems. Once lodged, other debris may thus become more easily lodged behind the first accumulated debris leading to further clogging of the gutter outfitted with an anti-debris screen or the like. In this regard, it has been noted that fine mesh filter screens and solid gutter covers provide excellent results as a means to guard against debris collection, the small seeds and needles being too large in magnitude to become lodged in a fine mesh filter screen (having apertures on the order of 40–200 microns) and the same being simply washed off solid gutter covers. However, fine mesh filter screens and solid gutter covers tend to favor water runoff. Further, a common problem associated with clogging is seam design. The presence of seams at the edges of adjacent screen portions often cause debris of various sizes to collect leading to clogging at the seam site. The present invention thus further contemplates a further alternative embodiment of the gutter screen assembly for minimizing water runoff and debris collection adjacent a gutter (which gutter has been earlier described) and attempts to address the problem of seam site debris collection.

Figure 10:
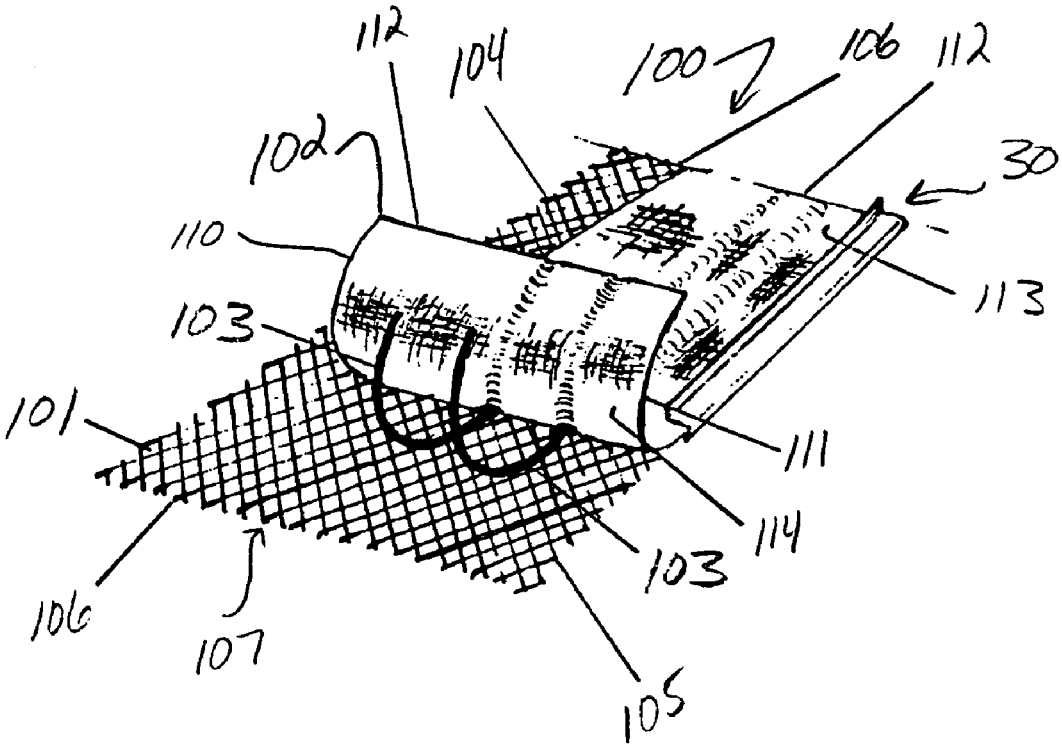
FIG. 10 is a fragmentary perspective view of a sixth alternative embodiment of the gutter screen assembly showing a filter support grid, a filter screen, and a pair of ridge-forming members.
Figure 11:
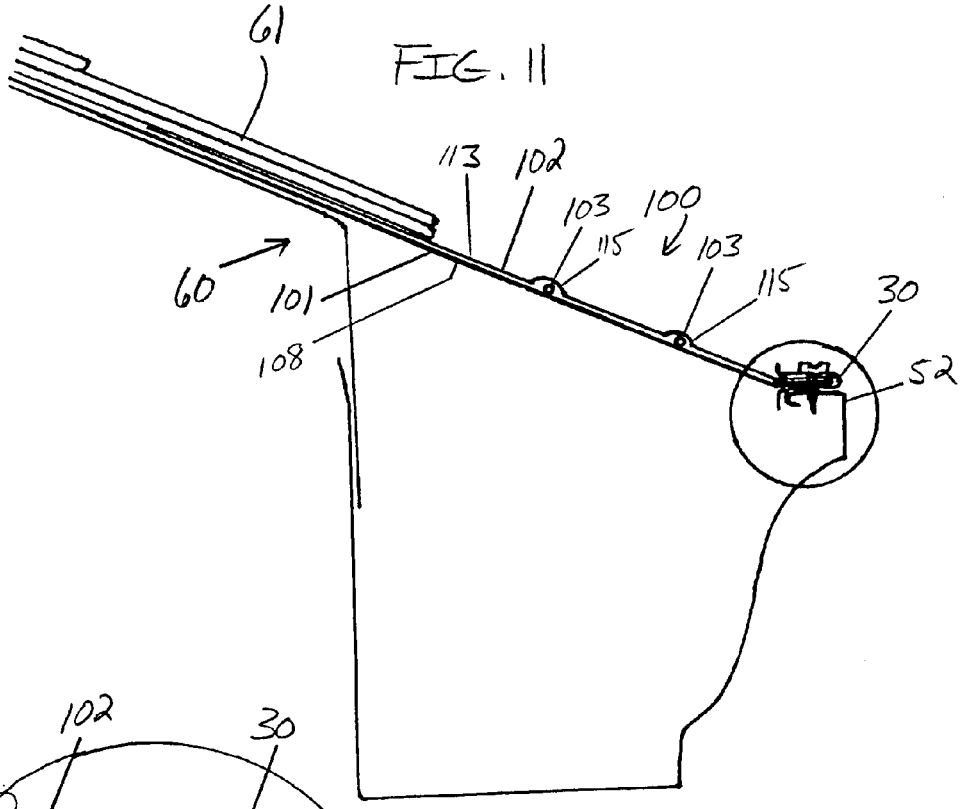
FIG. 11 is a fragmentary cross-sectional side view of a roof border region, a gutter, and the sixth alternative embodiment of the gutter screen assembly.
Figure 11A:
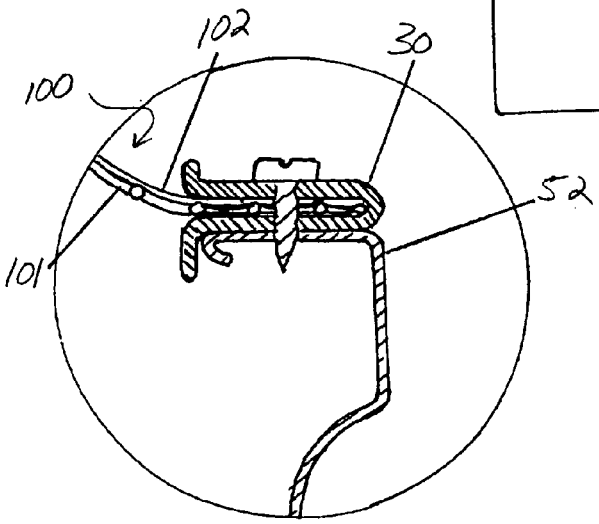
Figure 12:
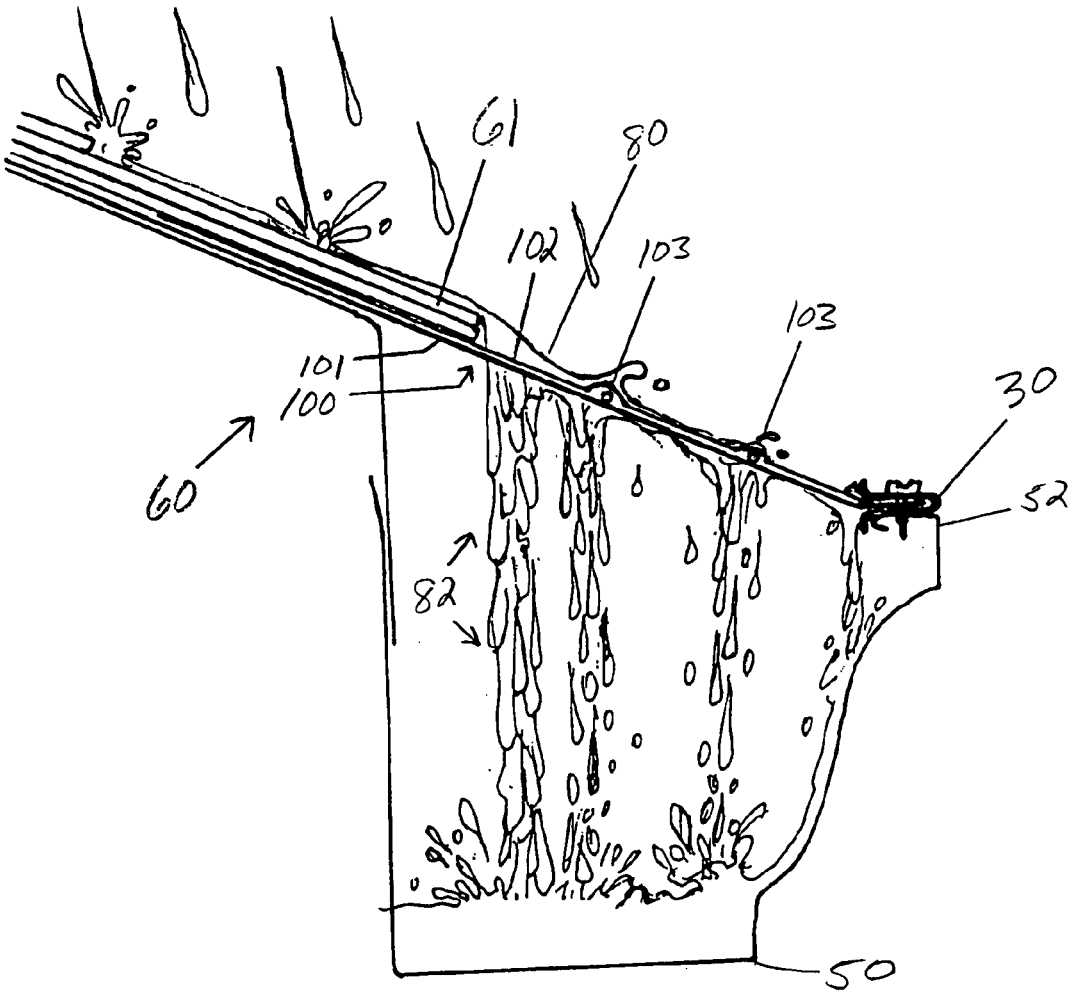
FIG. 12 is a fragmentary cross-sectional side view of a roof border region, a gutter, and the sixth alternative embodiment of the gutter screen assembly, depicting roof water runoff and gutter collection thereof.

The further embodiment of the gutter screen assembly preferably comprises, in combination a dual-layered gutter filter assembly 100 as illustrated and referenced in FIGS. 10–12; and gutter screen termination trim 30 (as earlier specified) as further referenced in FIGS. 10–12. Dual-layered gutter filter assembly 100 preferably comprises an inferior filter support layer or filter support grid 101 as illustrated and referenced in FIGS. 10–15, inclusive; a superior water filter layer or form-fitting filter screen 102 as illustrated and referenced in FIGS. 10–12, and 16–19; and at least one or preferably a plurality of substantially parallel elongate ridge-forming members 103 as illustrated and referenced in FIGS. 10, 11, 12, 14, and 15.

Figure 13:
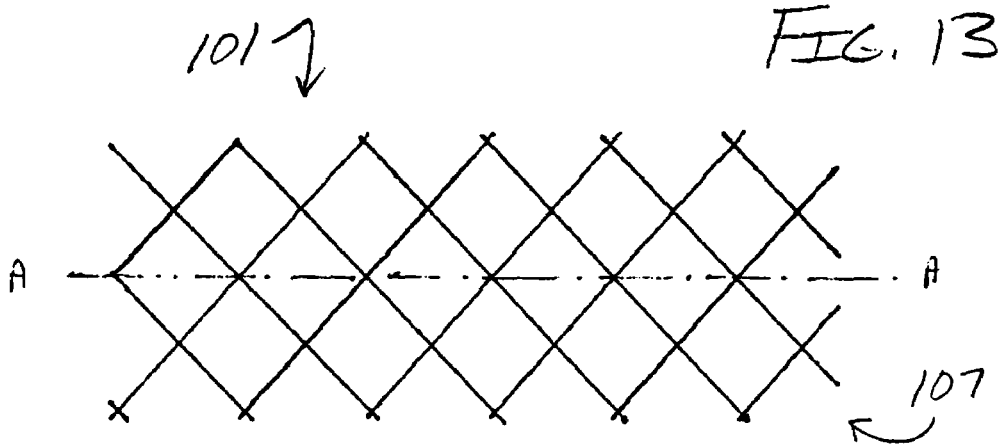
FIG. 13 is a fragmentary top plan view of the filter support grid of the sixth alternative embodiment of the gutter screen assembly.
Figure 13A:
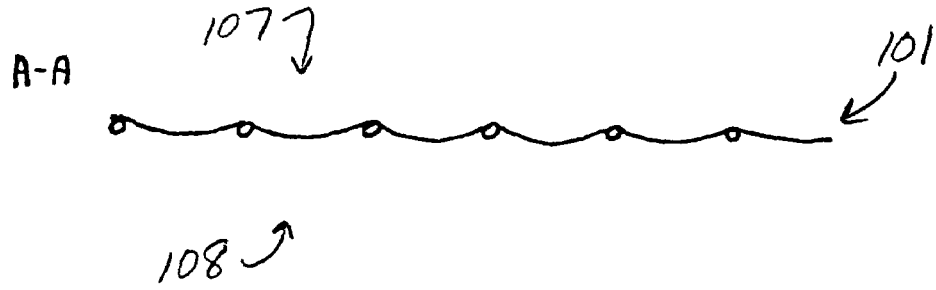
Figure 14:
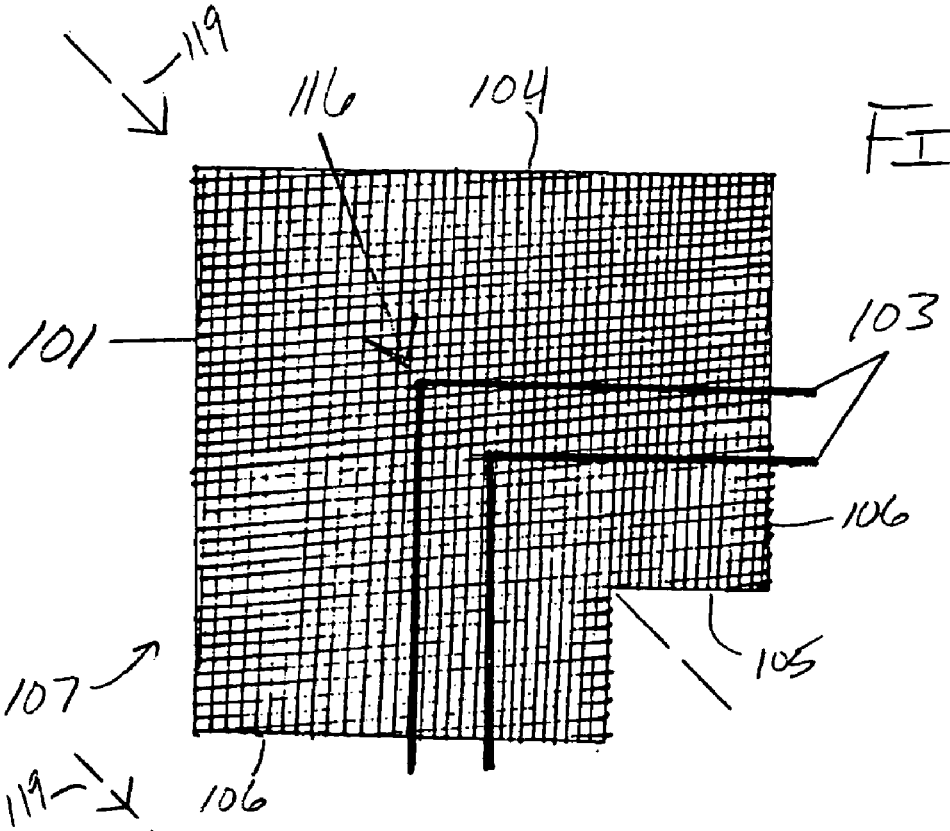
FIG. 14 is a fragmentary top plan view of a first corner embodiment of the filter support grid and a pair of ridge-forming members for installation adjacent an inside gutter corner.
Figure 15:
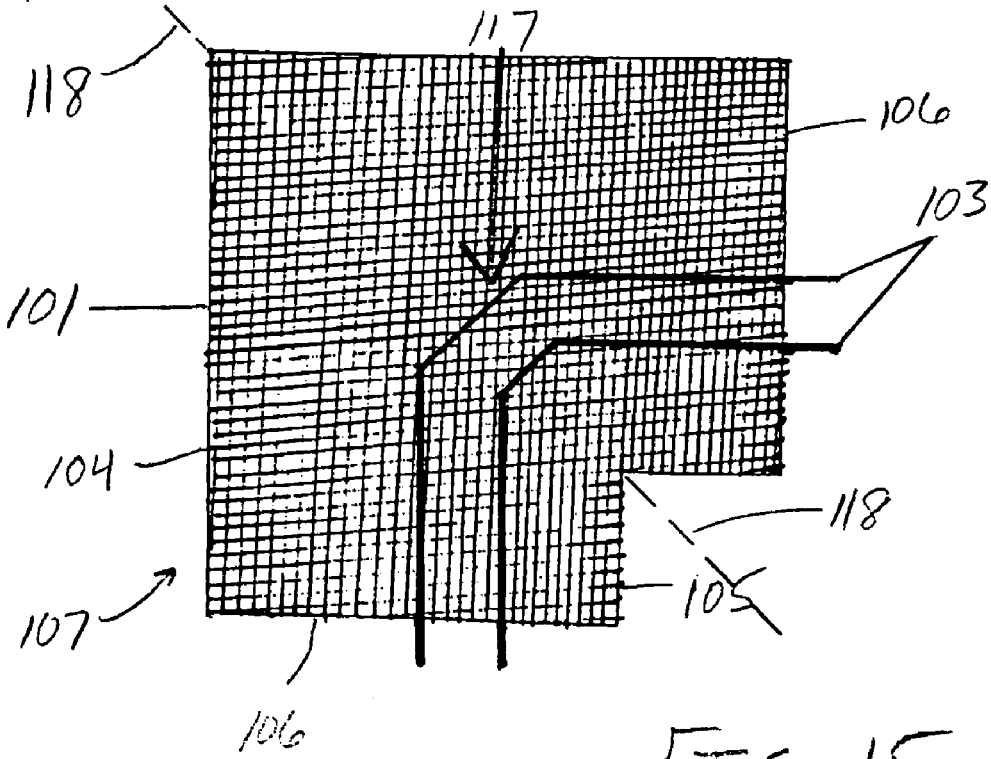
FIG. 15 is a fragmentary top plan view of a second corner embodiment of the filter support grid and a pair of ridge-forming members for installation adjacent an inside gutter corner.

Filter support grid 101 preferably comprises a roof-engaging grid edge 104 (akin to roof-engaging edge 21) as illustrated and referenced in FIGS. 10, 14, and 15; a gutter-engaging grid edge 105 (akin to gutter-engaging edge 22) as illustrated and referenced in FIGS. 10, 14, and 15; two latitudinally-opposed grid edges 106 (akin to latitudinally-opposed screen edges 23) as generally referenced in FIGS. 10, 14, and 15; a substantially planar, filter-supporting, water inlet grid surface 107 as illustrated and referenced in FIGS. 10, 13, 13(*a*), 14, and 15; and a water outlet grid surface 108 as referenced in FIG. 13(*a*).

Notably, latitudinally-opposed grid edges 106 are to be located primarily at the corner junctions of gutter systems as a means to avoid seam clogging issues. As will be described in more detail, hereinafter, the present invention provides a screen assembly that can be laid out in predetermined continuous lengths as required by the gutter installation site. In any event, when latitudinally-opposed grid edges 106 are referenced, the reader should note that edges 106 are to be preferably located at or adjacent the corner region of a gutter assembly so as to minimize the presence of seams along the general length of a gutter screen assemblage.

The inferior filter support layer or filter support grid 101 preferably comprises or is constructed from a flexible (rollable), thermally expansive material having an inherent average coefficient of thermal expansion (preferably some form of Ultraviolet (UV) protective plastic material) and is formed to comprise a repeating diamond-shaped aperture grid. In this regard, filter support grid 101 is very similar in construction as compared with gutter screen 20 except that a diamond-shaped aperture grid is to be preferred. It will be recalled that the present invention does contemplate a gutter screen 20 comprising a water-accepting grid or screen having diagonally aligned ribs, thus forming parallelogram-shaped or diamond-shaped water accepting apertures. Preferably, filter support grid comprises diamond shaped apertures having ½ inch by ⅜ inch strands per inch (i.e. three apertures per inch when measured diagonally), although it is contemplated that filter support grid 101 may comprise diamond shaped (or diagonal square) apertures ranging from 1 to 8 strands per inch. Notably, horizontal/vertical square, or rectangular shaped apertured grids will also work, but diagonal form is more popular and less expensive, and easily attachable to gutter screen termination trim 30.

Excellent results have been obtained utilizing ½"×⅜" (or ½"×½") so-called diamond shaped or diamond apertured support grid structure. Diamond shaped, as here used, is intended to mean the diagonal style, not the horizontal/vertical style as described above. However square shape (horizontal/vertical) screen size ½"×½" would also work well, but it would be not practical for two reasons: (1) diamond shape screen is much more popular and less expensive; (2) it also would be a problem with connecting ½" aperture square screen with ¾" wide gutter screen termination trim 30—in some cases the connecting screw would not be able to "catch" the screen strand.

The grid surfaces (water inlet grid surface 107 and water outlet grid surface 108) extend intermediate the grid edges (roof-engaging grid edge 105, gutter-engaging grid edge 104, and latitudinally-opposed grid edges 106) and thus function to inlet water via water inlet grid surface 107 and outlet water from water outlet grid surface 108. Filter support grid 101 further functions to provide support structure for filter screen 102 and ridge-forming members 103. Further, the thermal properties of the materials comprising filter support grid 101 fulfill a further function as will be described in more detail hereinafter.

The superior water filter layer or form-fitting filter screen 102 preferably comprises a roof-engaging filter edge 110 (roughly analogous to roof-engaging edge 21) as illustrated and referenced in FIG. 10; a gutter-engaging filter edge 111 (roughly analogous to gutter-engaging edge 22) as illustrated and referenced in FIG. 10; two latitudinally-opposed filter edges 112 (roughly analogous to latitudinally-opposed screen edges 23) as illustrated and referenced in FIG. 10; a water inlet filter surface 113 as illustrated and referenced in FIG. 10; and a water outlet filter surface 114 as illustrated and referenced in FIG. 10.

It is contemplated that form-fitting filter screen 102 is a continuous, very fine, flexible (rollable) stainless steel mesh to block virtually all matter but water from passing therethrough. In this regard, it is contemplated that the fine mesh filter screen be constructed from fine stainless steel mesh with water-accepting apertures on the order of 40–200 microns (preferably 100 microns) across. Notably, stainless steel mesh is a thermally expansive material and thus inherently has an average coefficient of thermal expansion associated therewith. For example, Austenitic Stainless Steel (304) comprises an average coefficient of thermal expansion on the order of 9.6 in/in. ° Fahrenheit (×10↑−6); Austenitic Stainless Steel (310) comprises an average coefficient of thermal expansion on the order of 8.0 in/in. ° Fahrenheit (×10↑−6); Austenitic Stainless Steel (316) comprises an average coefficient of thermal expansion on the order of 8.9 in/in. ° Fahrenheit (×10↑−6); and Ferritic Stainless Steel (410) comprises an average coefficient of thermal expansion on the order of 5.5 in/in. ° Fahrenheit (×10↑−6).

By way of comparison, plastics (the preferred material used in the construction of filter support grid 101) generally comprise an average coefficient of thermal expansion that is unequal in magnitude as compared to the average coefficient of stainless steel. For example, ABS thermoplastic comprises an average coefficient of thermal expansion on the order of 55 in/in. ° Fahrenheit (×10↑−6); CPVC thermoplastic comprises an average coefficient of thermal expansion on the order of 34 in/in. ° Fahrenheit (×10↑−6); and PVC thermoplastic comprises an average coefficient of thermal expansion on the order of 29 in/in. ° Fahrenheit (×10↑−6).

Thus, it will be noted that filter support grid 101 preferably comprises a first thermally expansive material (e.g. plastic) and filter screen 102 preferably comprises a second thermally expansive material (e.g. steel). The first thermally expansive material inherently has a first average coefficient of thermal expansion and the second thermally expansive material inherently has a second average coefficient of thermal expansion, the first and second average coefficients of thermal expansion being unequal in magnitude.

The filter surfaces (water inlet filter surface 113 and water outlet filter surface 114) extend intermediate the filter edges (roof-engaging filter edge 110, gutter-engaging filter edge 111, and latitudinally-opposed filter edges 112) and elongate, ridge-forming members 103 extend intermediate water inlet grid surface 107, water outlet filter surface 114, latitudinally-opposed grid edges 106 and filter edges 112 (respective grid edges 106 and filter edges 112 being substantially coplanar), and roof-engaging grid edges 104 and filter edges 110. In other words, ridge-forming members 103 are sandwiched intermediate filter support grid 101 and filter screen 102 and are latitudinally-aligned intermediate the latitudinally-opposite edges of the system substantially as illustrated in FIG. 10. When described as extending intermediate water inlet grid surface 107 and water outlet filter surface 114 and the latitudinally-opposed grid edges 106 and filter edges 112, it is contemplated that the reader will understand that ridge-forming members 103 are sandwiched intermediate filter support grid 101 and filter screen 102 and are latitudinally-aligned intermediate the latitudinally-opposite edges of the system.

Preferably, where more than one ridge-forming member 103 is thus sandwiched, the resulting plurality of ridge-forming members 103 run substantially parallel to one another (as further illustrated in FIG. 10). In the event that more than one ridge-forming member 103 is thus sandwiched, it is contemplated that the preferred spacing between adjacent ridge-forming members 103 is on the order of ½ inch and up (i.e. ½" is the minimum spacing). Preferably, each ridge-forming member 103 is constructed from or comprises flexible material such as string or wire of varying thicknesses (on the order of 1–5 millimeters), but preferably about 2.5 millimeters along general spans of the resulting assembly. Notably, however, at internal roof corners where water runoff is significantly greater in volume, it is contemplate that ridge-forming member(s) be constructed from materials about 4 millimeters in thickness.

Generic views of certain structure located adjacent internal roof corners have been depicted in FIGS. 14 and 15. In this regard, it should be noted that water runoff is in the direction of the arrow 119. It will be seen from a comparative inspection of the noted figures that the present embodiment contemplates at least two different configurations of the sandwiched ridge-forming member(s) 103. In the first instance, it is contemplated that ridge-forming member(s) 103 may form grooved, water-straining structure 116 against which water runoff will elevate (gain potential energy and lose kinetic energy). The grooved water-straining structure is essentially achieved by forming right angles with the ridge-forming member(s) 103 at the corner regions of the gutter assembly. This structure is generally referenced or depicted in FIG. 14. In the second instance, it is contemplated that ridge-forming member(s) may form perpendicular water-straining structure 117 against which water runoff will elevate (and lose kinetic energy). The perpendicular water-straining structure is essentially achieved by angling ridge-forming member(s) at regions adjacent the corner line (as referenced at 118 in FIG. 15) such that ridge-forming member(s) are otherwise orthogonal to corner line 118. Arcuate grooves or curved grooves or arcuate (or curved) water-straining structure are further contemplated but not specifically illustrated.

It will be noted from a further inspection of FIGS. 14 and 15 that the present invention contemplates that adjacent assembly structures may be seamed together away from or adjacent corner line 18. Seaming adjacent assembly structures along or coplanar with corner line 118 is problematic, since this is the region with the highest water runoff volume. Thus, it is contemplated that the seams be formed adjacent corner line 118 and may preferably be made at latitudinally-opposed edges 106 substantially as referenced in FIGS. 14 and 15.

Form-fitting filter screen 102 is preferably form fit to filter support grid 101 and ridge-forming members 103. The term "form fit" is here utilized to refer to a thermal connection made between filter support grid 101, ridge-forming member(s) 103, and filter screen 102. In this regard, it is contemplated that when the noted structures are aligned and thus preassembled, the resulting assembly may be heat pressed as a means to make integral the resulting assembly. In other words, the stainless steel filter screen is heat- or thermo-pressed into the softer plastic filter support grid, thus forming an integral form-fitted, dual-layered screen assembly. In other words, during the thermo-connection process (the form-fitting process), the stainless steel filter screen may become otherwise embedded in the plastic filter support guard and thus filter screen 102 becomes form fit to filter support grid 101 and ridge-forming member(s) 103 substantially as depicted in FIGS. 11 and 12.

It has been noted that filter screen 102 is preferably form fit to filter support grid 101 via a thermal connection process. It is contemplated that it may be possible to connect the two opposing layers using some kind of glue or other adhesive means instead. Further, it is contemplated that that filter support grid 101 may be constructed from relatively stiff or rigid materials and form-fitting filter screen 102 (comprising form0fitting materials) may be placed or wrapped upon filter support grid 101 and thus no structural connections would be required and the manufacturer could conceivably construct the assembly within minutes without using any tools.

Figure 16:
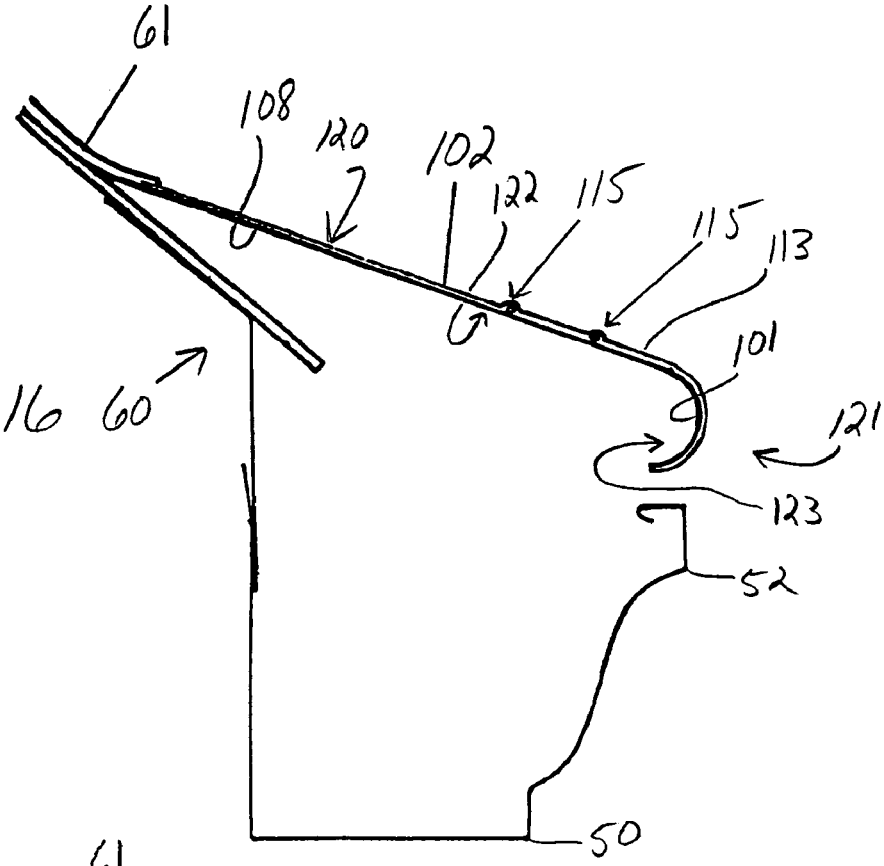
FIG. 16 is a fragmentary cross-sectional side view of a roof border region, a gutter, and a seventh alternative embodiment of the gutter screen assembly.

In the preferred embodiment, however, the form-fitted (heat- or thermo-pressed), dual-layered screen assembly thus forms at least one (perhaps a plurality) of energy-absorbing filter ridges 115 at water inlet filter surface 113 as illustrated and referenced in FIGS. 11 and 16. In this regard, it should be readily understood that when water film 80 (as further referenced in FIGS. 12, 18, and 19) translates downwardly toward roof-engaging filter edge 111, filter ridges 115 operate to increase the potential energy of the water film 80 (elevating the water film 80) thereby decreasing the kinetic energy of the water film 80. The resulting energy-absorbing interplay (non-ideal energy exchanges) operates to otherwise strain or interrupt the water surface tension of the water film 80. Thus, ridge members 115 operate to allow water to permeate or siphon through filter screen 102 (comprising water inlet filter surface 113 and water outlet filter surface 114) and filter support grid 101 (comprising water inlet grid surface 107 and water outlet grid surface 108) into the underlying gutter 50 or gutter assembly as may be seen from a general inspection of FIGS. 12, 18, and 19.

Due to the varied or unequal average coefficients of thermal expansion of the materials comprising filter support grid 101 and filter screen 102, the two materials return to normal operating temperatures with differing thermal properties. In other words, the contraction of materials when reverting to a normal operating temperature after having been heat- or thermo-pressed occurs at varying rates. It will be recalled that when the stainless steel filter screen 102 is heat pressed or form fit to the filter support grid 101 with sandwiched ridge-forming member(s) 103 therebetween, the filter screen 102 becomes lodged or embedded into the soft plastic material of the filter support grid 101. Upon cooling, the integrally-formed materials contract at differing rates and thus form a plurality of randomly-aligned water tension strainers at water inlet filter surface 113 (not specifically illustrated).

The randomly-aligned water tension strainers are essentially micro ridges that become raised under the contracting forces of the varied heat expansive materials, otherwise integrally bound to one another. The water tension strainers function to further strain the water surface tension of the water film 80 formed upon filter screen 102. Thus it will be understood that the water tension strainers, filter ridges 115 and the select tension-breaking breaker edge (as previously specified under descriptions of gutter screen termination trim 30) function to allow water to permeate through filter screen 102 and filter support grid 101 into gutter 50.

As earlier noted, filter support grid 101, filter screen 102, and ridge-forming member(s) preferably comprise flexible materials. The inherent flexibility of the form-fitted, dual-layered screen assembly thus enables the manufacturer to form the screen assembly in predetermined assembly lengths as may be required by the installer or the end-user. It will be recalled that the reduction of the number of seams (the eradication of the inevitable clogging of seams with debris) is of paramount importance and thus the manufacturer of the present invention may roll the otherwise flexible screen assembly into predetermined lengths for ease of storage and may then deliver to the user virtually any length of assembly as may be required.

A further embodiment of the present invention contemplates or provides a so-called reverse curve, dual-layered gutter screen assembly for minimizing water runoff and debris collection adjacent a gutter as generally depicted in FIGS. 16–19, inclusive. The so-called reverse curve, dual-layered gutter screen assembly preferably comprises, a superior water filter layer (or filter screen) 102 and an inferior filter support layer (or filter support grid) 101. It will be seen from an inspection of the noted figures that in this embodiment, gutter screen termination trim 30 is essentially removed and the rim-engaging portion of the gutter screen assembly is reverse-curved to thus oppose the gutter rim portion 52. The rim-engaging portions of the dual-layered screen assembly described above thus become collectively become "rim-opposing."

Figure 17:
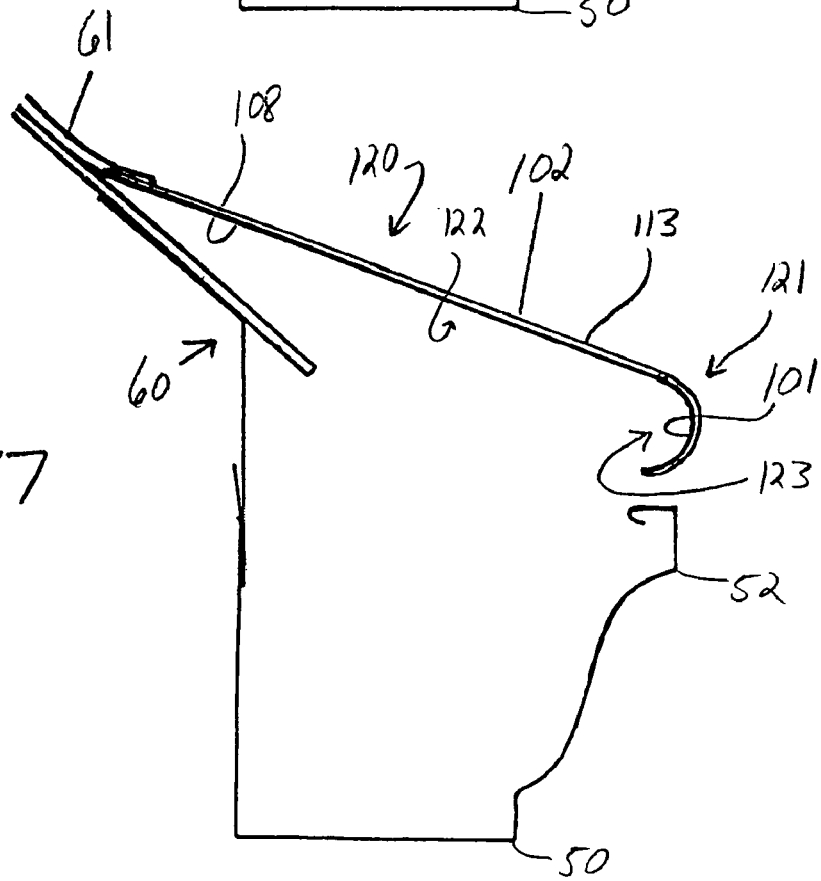
FIG. 17 is a fragmentary cross-sectional side view of a roof border region, a gutter, and an eighth alternative embodiment of the gutter screen assembly.

Water filter layer 102 thus preferably comprises a substantially planar filter portion 120, a reverse curve filter portion 121, water inlet filter surface 113, and a water outlet filter surface as illustrated and referenced in FIGS. 16 and 17. Similarly, filter support layer 101 preferably comprises a substantially planar support portion 122, a reverse curve support portion 123, a water inlet support surface, and a water outlet support surface 108 (akin to water outlet grid surface 108) as illustrated and referenced in FIGS. 16 and 17. It will be seen from an inspection of the noted figures that planar filter portion 120 is in superior adjacency to planar support portion 122 and reverse curve filter portion 121 is in outer adjacency to reverse curve support portion 123. The adjacent reverse curve filter portion 121 and reverse curve support portion 123 are designed to be spatially located in superior adjacency gutter rim portion 52.

Figure 18:
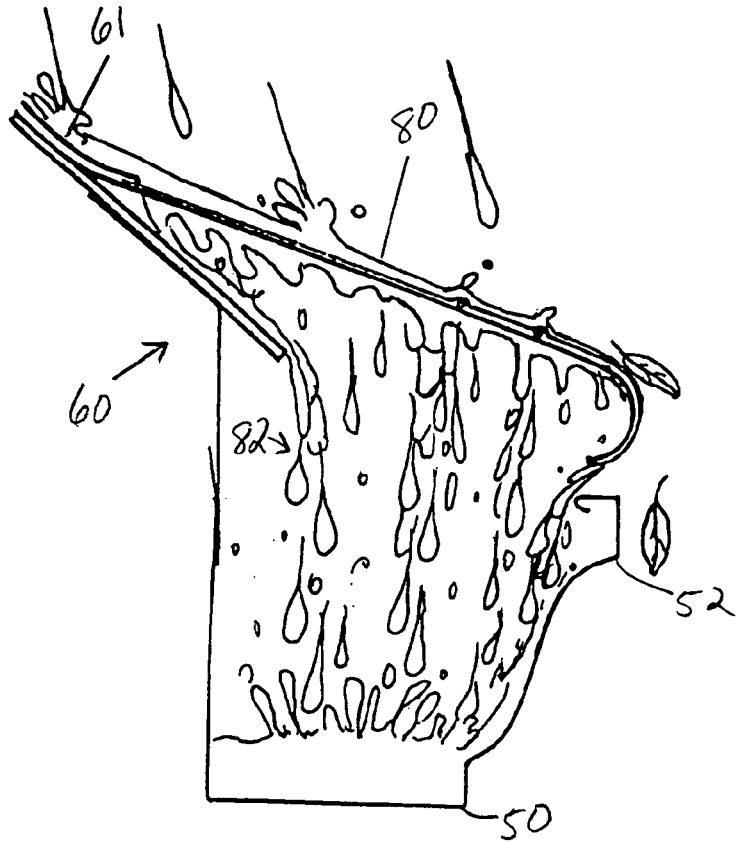
FIG. 18 is a fragmentary cross-sectional side view of a roof border region, a gutter, and the seventh alternative embodiment of the gutter screen assembly, depicting roof water runoff and gutter collection thereof.
Figure 19:
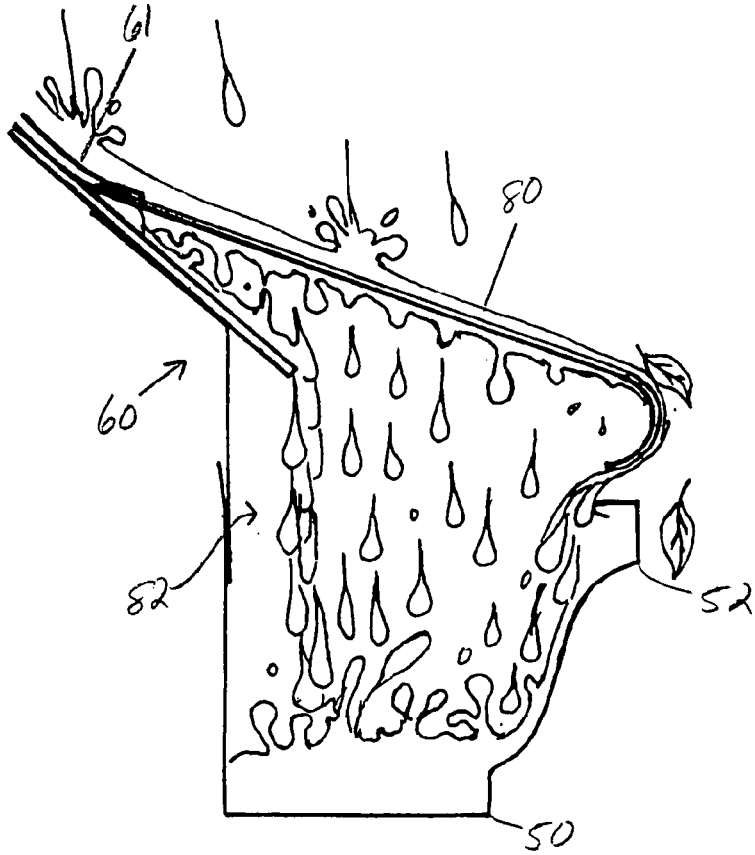
FIG. 19 is a fragmentary cross-sectional side view of a roof border region, a gutter, and the eighth alternative embodiment of the gutter screen assembly, depicting roof water runoff and gutter collection thereof.

Any number of bracing systems or assemblies can be utilized to achieve this rim-opposing feature, including the inherent rigidity of the filter support layer 101. It is believed that such bracing structures are well within the knowledge of one skilled in the art and thus no further descriptions of the same are here presented. Thus, water filter layer 102 and filter support layer 101 function to allow water to permeate from water inlet filter surface 113 to the water outlet filter surface to the water inlet support surface to the water outlet support surface 108 to the gutter 50 or gutter assembly situated thereunder as generally depicted in FIGS. 18 and 19. In this regard, it is contemplated that a large portion of water runoff is able to permeate or siphon through the assemblage into gutter 50 and the remainder of water runoff, if any, will follow the reverse curve into gutter 50 via the space immediately superior to gutter rim portion 52 as generally depicted in FIGS. 18 and 19. It will thus be understood that in either event, water filter layer 102 and filter support layer 101 function to allow water to permeate to gutter 50 via water inlet filter surface 113 (either by siphoning through the water filter layer and filter support layer or by traveling along the reverse curve through the space intermediate reverse curve portions 121 and 123 and gutter rim portion 52. Such device could be installed anywhere where there is more running water than the existing gutter protection system can handle.

Thus it will be seen that the present invention discloses certain water surface tension-breaking means or water tension-straining means cooperatively associated with the planar structural portions of reverse curve gutter configurations so as to break or strain water surface tension at the planar portions and further make use of the water surface tension at the reverse curve portions (of the overall reverse curve design) to allow water film to follow the reverse curve into the gutter situated underneath the reverse curve gutter shield.

It will be seen that the present invention provides a low cost, maintenance-efficient gutter screen assembly, which gutter screen assembly enables the user to simultaneously (1) break or strain the water surface tension of water film runoff, thus allowing water-accepting grids or regions installed on gutters to accept greater quantities of water, thereby reducing "over-the-edge" water runoff, and (2) prevent or minimize debris collection upon the gutter screen. In this regard, it will be seen that the present invention provides a gutter screen termination trim and/or water surface tension interrupters for use in combination with a gutter screen, which gutter screen termination trim or water surface tension interrupters embody improvements over the state of the art. In this last regard, it will be seen that the present invention provides a uniquely configured structure for decreasing or eliminating water film runoff, which water film runoff is notably problematic in state of the art gutter screens. Further, it will be seen that the present invention provides a gutter screen assembly constructed or formed into a readily reversible gutter screen attachment for installation in either heavy water film runoff or typical water film runoff application scenarios.

More particularly, it will be seen that the present invention provides a uniquely configured gutter screen attachment or gutter screen termination trim with water tension breaker for use in combination with a conventional gutter and angled, planar gutter screen. The resulting gutter screen assembly provides a means for minimizing water runoff and debris collection adjacent a conventional gutter. It will be seen that the gutter screen assembly preferably comprises, in combination a gutter screen and a gutter screen termination trim. The gutter screen itself essentially provides a water-accepting grid or region comprising a plurality of edges, including a roof-engaging edge, a gutter-engaging edge, and two latitudinally-opposed screen edges. The gutter screen further essentially comprises a plurality of longitudinally-aligned ribs extending from the roof-engaging edge to the gutter-engaging edge, and a plurality of latitudinally-aligned ribs extending intermediate the latitudinally-opposed screen edges. The longitudinally-aligned ribs intersect with the latitudinally-aligned ribs and thus form a series of intersection points. The longitudinally-aligned ribs, the latitudinally-aligned ribs and the intersection points together define a substantially planar water-accepting grid.

It should be reiterated that the present described alternative embodiments of the present invention may be used in combination with a host of variably constructed water-accepting grids or screens comprising water-accepting apertures of various shapes and sizes. The above description is intended as a preferred specification of the ideal water-accepting grid and is not meant to any way limit the present invention. For example, it is contemplated that the present invention may be used in combination with water-accepting grid or screen having diagonally aligned ribs, thus forming parallelogram-shaped or diamond-shaped water accepting apertures. Screens of this type may also be successfully used in combination with the present invention. Excellent results have been obtained, however, utilizing a water-accepting grid substantially as earlier described.

The water tension breaker or water surface tension interrupters thus provide a means for breaking water tension of a water film formed upon a water-accepting grid of filter and thus essentially comprises a substantially vertical water path interrupting structure substantially as described herein, which water surface tension interrupter is cooperatively associated with a gutter screen. It is thus contemplated that the water surface tension interrupter functions to allow water to more properly permeate through the water-accepting grid of filter into the gutter.

While the above description contains much specificity, this specificity should not be construed as limitations on the scope of the invention, but rather as an exemplification of the invention. For example, as is described hereinabove, it is contemplated that the edge-receiving fold and gutter-engaging edge 22 are designed for fixed attachment in superior adjacency to gutter rim portion 52. It will be recalled that the edge-receiving fold and gutter-engaging region 22 are preferably affixed in superior adjacency to gutter rim portion 52 such that select positioning breaker edge 31 extends downwardly snugly adjacent inner rim edge 53 as most clearly illustrated in FIG. 1(*a*). It will be further recalled that select positioning breaker edge 31 is intended, in part, to serve a positioning function by enabling the installer of gutter screen termination trim 30 to more properly position gutter screen termination trim 30 upon installation. In this regard, it is further contemplated that select positioning breaker edge may terminate in the breaker plane with no vertical dimension and still successfully fulfill a positioning function. In other words, it is contemplated that the select positioning breaker edge may be defined by the inferior terminus of the edge-engaging region, which terminus would necessarily lie either in or adjacent the breaker plane. The select positioning breaker edge could thus be used to properly position the gutter screen termination trim. While it is noted that constructing the gutter screen termination trim in this manner necessarily eliminates the reversible nature of the gutter screen termination trim, it is believed that the spirit of the present invention is still practiced.

Further, it is noted that various types of grid or screen systems are available to users. In this regard, it is contemplated that the gutter screen termination trim need not be installed on, or used in connection with, a gutter screen comprising longitudinally-aligned and latitudinally-aligned ribs as described herein. Rather, it is contemplated that the gutter screen termination trim may be used in connection with gutter screens, upon which water films tend to form.

Further, it is contemplated that the spirit of the foregoing descriptions teach a gutter screen assembly for minimizing water runoff and debris collection adjacent a gutter, the gutter comprising a roof-engaging portion and a gutter rim portion, the roof-engaging portion being affixed adjacent a roof border region, the gutter screen assembly comprising, in combination a dual-layered gutter filter assembly and at least one select water tension interrupter. The gutter filter assembly comprises a filter support grid and a form-fitting filter screen. The filter support grid comprises a roof-engaging grid edge, a rim-opposing grid edge, two latitudinally-opposed grid edges, a filter-supporting, water inlet grid surface, and a water outlet grid surface. The grid surfaces extend intermediate the grid edges. The filter screen comprises a roof-engaging filter edge, a rim-opposing filter edge, two latitudinally-opposed filter edges, a water inlet filter surface, and a water outlet filter surface. The filter surfaces extend intermediate the filter edges. The filter screen is integrally form fit to the filter support grid thus forming a form-fitted, dual-layered screen assembly.

The select water tension interrupter may be selected from the group consisting of a water tension breaker and a ridge-forming member. The water tension breaker comprises a raised tension-breaking member intermediate the latitudinally-opposed grid edges and filter edges, the tension breaking member being cooperatively associated with the water inlet filter surface for breaking the water surface tension of a water film formed upon the filter screen. The ridge-forming member is sandwiched intermediate the filter support grid and the filter screen for forming an energy-absorbing filter ridge at the water inlet filter surface. The energy-absorbing filter ridge operates to interrupt or strain the water surface tension of the water film formed upon the filter screen. Thus, the select water tension interrupter allows water to permeate through the filter screen and the filter support grid into the gutter.

Accordingly, although the invention has been described by reference to a preferred embodiment, it is not intended that the novel assembly be limited thereby, but that modifications thereof are intended to be included as falling within the broad scope and spirit of the foregoing disclosure, the following claims and the appended drawings.

I claim:

1. A gutter screen assembly for minimizing water runoff and debris collection adjacent a gutter, the gutter comprising a roof-engaging portion and a gutter rim portion, the roof-engaging portion being affixed adjacent a roof border region, the gutter screen assembly comprising a filter support grid, a form-fitting filter screen, and at least one ridge-forming member, the filter support grid comprising a roof-engaging grid edge, a rim-engaging grid edge, two latitudinally-opposed grid edges, a filter-supporting, water inlet grid surface, and a water outlet grid surface, the grid surfaces extending intermediate the grid edges, the filter screen comprising a roof-engaging filter edge, a rim-engaging filter edge, two latitudinally-opposed filter edges, a water inlet filter surface, and a water outlet filter surface, the filter surfaces extending intermediate the filter edges, the ridge-forming member extending intermediate the water inlet grid surface, the water outlet filter surface, and the latitudinally-opposed grid edges and filter edges, the filter screen being form fit to the grid surface and the ridge-forming member thus forming a form-fitted, dual-layered screen assembly, the ridge-forming member thus forming an energy-absorbing filter ridge at the water inlet filter surface, the energy-absorbing filter ridge for straining the water surface tension of a water film formed upon the filter screen, the filter ridge thus allowing water to permeate through the filter screen and the filter support grid into the gutter.

2. The gutter screen assembly of claim 1 wherein the gutter screen assembly comprises a gutter screen termination trim, the gutter screen termination trim comprising a substantially vertical first breaker edge, a substantially vertical second breaker edge, a select positioning breaker edge, a select tension-breaking breaker edge, and a screen-receiving region intermediate the first and second breaker edges, the select breaker edges each being selected from the group consisting of the first and second breaker edges, the first and second breaker edges being substantially coplanar, the screen-receiving region comprising an edge-receiving fold, the edge-receiving fold comprising a substantially U-shaped edge and two substantially parallel edge-engaging regions, the edge-receiving fold receiving the rim-engaging grid and filter edges, the edge-receiving fold thus sandwiching the rim-engaging grid and filter edges intermediate the edge-engaging regions, the roof-engaging grid and filter edges being affixed adjacent the roof border region, the edge-receiving fold and rim-opposing grid and filter edges being affixed in superior adjacency to the gutter rim portion, the select positioning breaker edge extending downwardly snugly adjacent the inner rim edge, the U-shaped edge being spatially located in superior adjacency to the outer rim edge, the select tension-breaking breaker edge extending upwardly opposite the select positioning breaker edge, the select tension-breaking breaker edge for breaking the water surface tension of the water film formed upon the filter screen, the filter ridges and the select tension-breaking breaker edge thus allowing water to permeate through the filter screen and the filter support grid into the gutter.

3. The gutter screen assembly of claim 2 wherein the first breaker edge, the second breaker edge, and the ridge-forming member each have a measurable vertical dimension, the measurable vertical dimensions each being selected from a dimension range, the dimension range ranging from about 1 millimeter to about 6 millimeters.

4. The gutter screen assembly of claim 3 wherein the measurable vertical dimension of the first breaker edge measures about 3 millimeters, the measurable vertical dimension of the second breaker edge measures about 6 millimeters, and the measurable vertical dimension of the ridge-forming member is about 2.5 millimeters.

5. The gutter screen assembly of claim 1 wherein the filter support grid comprises a first thermally expansive material and the filter screen comprises a second thermally expansive material, the first thermally expansive material having a first average coefficient of thermal expansion and the second thermally expansive material having a second average coefficient of thermal expansion, the first and second average coefficients of thermal expansion being unequal, the filter screen being thermally form fit to the filter support grid and the ridge-forming members, the thermally form fit filter screen thus forming a plurality of randomly-aligned water tension strainers at the water inlet filter surface, the water tension strainers for straining the water surface tension of the water film formed upon the filter screen, the water tension strainers and the filter ridges thus allowing water to permeate through the filter screen and the filter support grid into the gutter.

6. The gutter screen assembly of claim 1 wherein the filter support grid, the filter screen, and the ridge-forming member comprise flexible materials, the form-fitted, dual-layered screen assembly being formable in predetermined assembly lengths, the predetermined assembly lengths thus being rollable for ease of storage.

* * * * *